US006790584B2

(12) United States Patent
Ito et al.

(10) Patent No.: US 6,790,584 B2
(45) Date of Patent: Sep. 14, 2004

(54) SILVER HALIDE PHOTOGRAPHIC LIGHT-SENSITIVE MATERIAL

(75) Inventors: Tadashi Ito, Minami-ashigara (JP); Toshiaki Kubo, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/393,008

(22) Filed: Mar. 21, 2003

(65) Prior Publication Data

US 2003/0228547 A1 Dec. 11, 2003

(30) Foreign Application Priority Data

Mar. 22, 2002 (JP) ..... 2002-081628

(51) Int. Cl.[7] ..... G03C 1/42; G03C 1/295; G03C 1/76; G03C 1/93

(52) U.S. Cl. ..... 430/264; 430/523; 430/531; 430/533; 430/536; 430/539

(58) Field of Search ..... 430/264, 523, 430/531, 533, 536, 539

(56) References Cited

U.S. PATENT DOCUMENTS 4,173,480 A * 11/1979 Woodward ..... 430/536
5,869,217 A * 2/1999 Aono ..... 430/527
6,025,119 A 2/2000 Majumdar et al.

FOREIGN PATENT DOCUMENTS

| | | | |
|---|---|---|---|
| EP | 0 644 454 | A1 | 3/1995 |
| EP | 0 813 105 | A1 | 12/1997 |
| EP | 0 905 560 | A1 | 3/1999 |
| JP | 11 038553 | A | 2/1999 |
| JP | 11 043899 | A | 2/1999 |

OTHER PUBLICATIONS

Database WPI XP002247741.

Database WPI XP002247742.

* cited by examiner

*Primary Examiner*—Richard L. Schilling
(74) *Attorney, Agent, or Firm*—Birch, Stewart, Kolasch, & Birch, LLP.

(57) ABSTRACT

A silver halide photographic light-sensitive material having layers containing a swellable inorganic stratifying compound on both sides of a support and having at least one silver halide emulsion layer on at least one of the layers. There is provided a silver halide photographic light-sensitive material showing good dimensional stability.

17 Claims, No Drawings

SILVER HALIDE PHOTOGRAPHIC LIGHT-SENSITIVE MATERIAL

TECHNICAL FIELD

The present invention relates to a silver halide photographic light-sensitive material. In particular, the present invention relates to a silver halide photographic light-sensitive material used for a photomechanical process and a photographic light-sensitive material used for IC printed boards.

RELATED ART

It is an integrated circuit (IC) that supports the today's highly information-oriented society from the aspect of hardware. It can be said that ICs are used because of their characteristics such as high processing speed, high reliability, low power consumption, low price, high functionality, light weight and small size. Meanwhile, for photographic light-sensitive materials, for example, light-sensitive materials for making printing plates, especially those used for IC printed circuit boards, high reliability is required, and ICs play an important role. For example, a circuit pattern is prepared with the aid of computer-aided design (CAD), and a photographic light-sensitive material is exposed in this pattern in a full scale or reduced scale, developed and fixed to prepare a negative. A copper plate (or copper foil) applied with a resist is exposed using this negative as a mask by contact exposure or projection exposure in a reduced size usually using a mercury lamp so that the resist should be chemically denatured by ultraviolet rays emitted by the mercury lamp. There are a negative type resist and a positive type resist. In the former type, a portion irradiated with ultraviolet rays is not dissolved and remains in the subsequent development step, and a portion not irradiated with ultraviolet rays is dissolved in a developer. The reverse is applied to the positive type resist. In the both cases, for use of a negative of photographic light-sensitive material as a mask in contact exposure or projection exposure in a reduced size on a copper plate (or copper foil) applied with a resist, reproducibility of the negative image of the photographic light-sensitive material (stability for the development) and dimensional stability of the negative during passage of time after the production of the negative image are important.

In photomechanical processes used in the field of graphic arts, used is a method in which photographic images of continuous tone are converted into so-called dot images in which variable image density is represented by sizes of dot areas, and such images are combined with photographed images of characters or line originals to produce printing plates. For silver halide photographic light-sensitive materials used for such a purpose, ultrahigh contrast photographic characteristic enabling clear distinction between image portions and non-image portions has been required in order to obtain favorable reproducibility of characters, line originals and dot images. Silver halide photographic light-sensitive materials having such an ultrahigh photographic characteristic have a characteristic that they shows higher density (higher practice density) compared with low contrast materials even when laser exposure is performed with exposure giving the same half tone percentage. Therefore, for use in IC printed boards, suitability of resist for exposure is markedly improved.

As a system responding to such a requirement, there has been known the so-called lithographic development method, in which a silver halide light-sensitive material comprising silver chlorobromide is treated with a hydroquinone developer having an extremely low effective concentration of sulfite ions to form images of high contrast. However, in this method, the developer is extremely unstable against oxidation by air since the sulfite ion concentration in the developer is extremely low, and therefore a lot of developer must be replenished in order to stably maintain the developer activity.

As image forming systems in which the instability of the image formation according to the lithographic development method is eliminated and light-sensitive materials are processed with a developer showing good storage stability to obtain ultrahigh contrast photographic characteristic, there can be mentioned those described in U.S. Pat. Nos. 4,166,742, 4,168,977, 4,221,857, 4,224,401, 4,243,739, 4,269,922, 4,272,606, 4,311,781, 4,332,878, 4,618,574, 4,634,661, 4,681,836, 5,650,746 and so forth. These are systems in which a silver halide photographic light-sensitive material of surface latent image type containing a hydrazine derivative is processed with a developer containing hydropuinone/metol or hydroquinone/phenidone as main developing agents and 0.15 mol/l or more of sulfite preservative and having pH of 11.0–12.3 to form ultrahigh contrast negative images having a gamma of 10 or higher. According to these systems, photographic characteristics of ultrahigh contrast and high practice density can be obtained, and because sulfite can be added to the developer at a high concentration, stability of the developer to air oxidation is markedly improved compared with conventional lithographic developers.

In order to form sufficiently ultrahigh contrast images with use of a hydrazine derivative, it is necessary to perform processing with a developer having pH of 11 or higher, usually 11.5 or higher. Although it has become possible to increase the stability of the developer by use of a sulfite preservative at a high concentration, it is necessary to use such a developer of high pH as described above in order to obtain ultrahigh contrast photographic images, and the developer is likely to suffer from air oxidation and hence instable even with the presence of the preservative. Therefore, various attempts have been made in order to realize ultrahigh contrast images with a lower pH to further improve stability of the developer.

For example, U.S. Pat. No. 4,269,929 (Japanese Patent Laid-open Publication (Kokai, henceforth referred to as "JP-A") No. 61-267759), 4,737,452 (JP-A-60-179734), U.S. Pat. Nos. 5,104,769, 4,798,780, JP-A-1-179939, JP-A-1-179940, U.S. Pat. Nos. 4,998,604, 4,994,365 and JP-A-8-272023 disclose methods of using a highly active hydrazine derivative and a nucleation accelerator in order to obtain ultrahigh contrast images of high practice density by using a developer having pH of less than 11.0. However, silver halide photographic light-sensitive materials used for such image-forming systems have a problem concerning processing stability such as fluctuation of sensitivity caused by change of activities of the hydrazine compound and the nucleation accelerator due to exhaustion of processing solutions, and therefore a stable image formation system providing high practice density has been desired, especially for photographic light-sensitive materials for IC printed boards.

Meanwhile, silver halide photographic light-sensitive materials are generally produced by applying at least one photographic light-sensitive layer on a plastic film support consisting of a fibrous material type polymer, of which typical example is triacetyl cellulose, or a polyester type polymer, of which typical example is polyethylene terephthalate. Since the polyethylene terephthalate films have or show superior mechanical properties, dimensional stability and high productivity, they are considered to be able to replace triacetyl cellulose, and they are used for silver halide photographic light-sensitive materials for use in bright rooms, scanners, facsimiles, IC printed circuit boards and so forth. However, lengths of polyethylene terephthalate films change due to moisture absorption or dehydration caused depending on the environmental humidity, and thus their dimensional stability is insufficient. As a technique for improving this problem, JP-A-63-304249 and so forth disclose a technique of providing a polyvinylidene chloride barrier layer in order to reduce the dimensional change caused by moisture absorption of a support. However, when such layer is provided on a support, there arise problems in that dechlorination gradually advances during storage for a long period of time and thereby images cause yellowing, dimensional change is caused during a further longer period of time, and so forth. Therefore, a technique for suppressing dimensional change due to humidity change has been desired.

In view of these problems of the conventional techniques, an object of the present invention is to provide a silver halide photographic light-sensitive material that shows good dimensional stability, further, such a silver halide photographic light-sensitive material also showing high practice density and good processing stability.

SUMMARY OF THE INVENTION

As a result of various researches of the inventors of the present invention, it was found that a silver halide photographic light-sensitive material that could achieve the aforementioned object could be produced by forming a layer containing a particular material, and thus the present invention described below was accomplished.

[1] A silver halide photographic light-sensitive material having layers containing a swellable inorganic stratifying compound on both sides of a support and having at least one silver halide emulsion layer on at least one of the layers.

[2] The silver halide photographic light-sensitive material according to [1], which contains polyvinyl alcohol as a binder of the layers containing the swellable inorganic stratifying compound.

[3] The silver halide photographic light-sensitive material according to [1], which contains polymer latex as a binder of the layers containing the swellable inorganic stratifying compound.

[4] The silver halide photographic light-sensitive material according to any one of [1] to [3], wherein the swellable inorganic stratifying compound and the binder are contained in the layers containing the swellable inorganic stratifying compound in a weight ratio of 1/10–10/1.

[5] The silver halide photographic light-sensitive material according to any one of [1] to [4], wherein the swellable inorganic stratifying compound has a mean aspect ratio of 100 or more.

[6] The silver halide photographic light-sensitive material according to any one of [1] to [5], wherein the swellable inorganic stratifying compound is swellable synthetic mica.

[7] The silver halide photographic light-sensitive material according to any one of [1] to [6], wherein the swellable inorganic stratifying compound is bentonite.

[8] The silver halide photographic light-sensitive material according to any one of [1] to [7], which comprise at least one hydrazine compound in at least one layers formed on the side of the support having the silver halide emulsion layer.

[9] The silver halide photographic light-sensitive material according to [8], wherein the hydrazine compound is a hydrazine compound having an onium group in the molecule.

[10] The silver halide photographic light-sensitive material according to [9], wherein the hydrazine compound having an onium group in the molecule is represented by the following formula (1) or (2):

Formula (1)

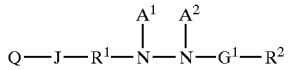

(1)

Formula (2)

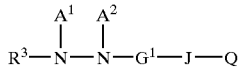

(2)

wherein, in the formulas (1) and (2), $R^1$ represents an arylene group or a divalent heterocyclic group, Q represents an onium group, J represents a divalent bridging group, $G^1$ represents —CO—group, —$SO_2$—group, —SO—group, —COCO—group, thiocarbonyl group, iminomethylene group or —P(O)($G^2R^4$)—group, where $G^2$ represents a single bond, —O—group or —$NR^4$—group, and $R^4$ represents a hydrogen atom, an aliphatic group, an aryl group or a heterocyclic group, $R^2$ represents a hydrogen atom, an alkyl group, an aryl group, a heterocyclic group, an alkoxyl group, an aryloxy group, an amino group or a carbamoyl group, $R^3$ represents an aryl group or a heterocyclic group, and both of $A^1$ and $A^2$ represent a hydrogen atom, or one of them represents a hydrogen atom, and the other represents an acyl group, a sulfonyl group or an oxalyl group.

[11] The silver halide photographic light-sensitive material according to [10], wherein the hydrazine compound having an onium group in the molecule is represented by the formula (1).

[12] The silver halide photographic light-sensitive material according to [11], wherein, in the formula (1), an atom of J directly bonding to $R^1$ is not a nitrogen atom.

[13] The silver halide photographic light-sensitive material according to [11] or [12], wherein, in the formula (1), the group represented by $G^1$ is —CO—, and the group represented by $R^2$ is an alkyl group that does not have an onium group or a carbamoyl group that does not have an onium group.

[14] The silver halide photographic light-sensitive material according to any one of [11] to [13], wherein, in the formula (1), the group represented by —$G^1$—$R^2$ is —$COCF_2H$ or —$COCF_2CF_2COOM$ (M represents a hydrogen atom or a counter cation).

[15] The silver halide photographic light-sensitive material according to any one of [11] to [14], wherein, in the formula (1), the bridging group represented by $R^1$ is an unsubstituted phenylene group.

[16] The silver halide photographic light-sensitive material according to [11], wherein the compound of the formula (1) is represented by the following formula (1-a) or (1-b).

Formula (1-a)

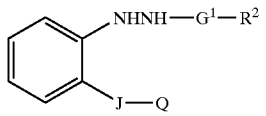

(1-a)

Formula (1-b)

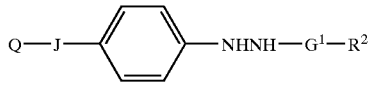

(1-b)

wherein, in the formulas (1-a) and (1-b), $—G^1—R^2$ is $—COCF_2H$ or $—COCF_2CF_2COOM$ (M represents a hydrogen atom or a counter cation), J represents an alkylene group, and Q represents a pyridinium group or a quinolinium group.

BEST MODE FOR CARRYING OUT THE INVENTION

The silver halide photographic light-sensitive material of the present invention will be explained in detail hereafter. In the present specification, ranges indicated with "-" mean ranges including the numerical values before and after "-" as the minimum and maximum values, respectively.

Examples of the swellable inorganic stratifying compound used in the present invention include swellable clay minerals such as bentonite, hectonite, saponite, beidellite, nontronite, stevensite and montmorillonite, swellable synthetic mica, swellable synthetic smectite and so forth. These swellable inorganic stratifying compounds have a laminate structure comprising unit crystal lattice layers having a thickness of 10–15 angstroms, and show metal atom substitution in lattices of a markedly higher degree compared with other clay minerals. As a result, the lattice layers causes shortage of positive charges, and cations such as $Na^+$, $Ca^{2+}$ and $Mg^{2+}$ are adsorbed between the layers to compensate it. The cations present between the layers are called exchangeable cations and exchanged with various cations. When the cations between the layers consist of $Li^+$ and $Na^+$, in particular, the small ionic radii provide weak linkage of stratifying crystal lattices, and thus the compound markedly swells with water. If shear is applied to the compound in that state, the compound is easily cleaved and form stable sol in water. Sentonite and swellable synthetic mica strongly tend to show that property, and they are preferred for the purpose of the present invention. In particular, swellable synthetic mica can be preferably used.

Examples of the swellable synthetic mica used for the present invention include Na tetrasic mica $NaMg_{2.5}(Si_4O_{10})F_2$, Na or Li teniorite $(NaLi)Mg_2Li(Si_4O_{10})F_2$, Na or Li hectorite $(NaLi)_{1/3}Mg_{2/3}Li_{1/3}(Si_4O_{10})F_2$ and so forth. Further, examples of the swellable synthetic smectite include $(Al_{8/6}Mg_{5/6})Si_4O_{10}(OH)_2.K_{1/3}.H_2O$, $(Fe^{III}_{5/3}Mg_{1/3})Si_4O_{10}(OH)_2.Na_{1/3}.H_2O$, and so forth.

The swellable synthetic mica preferably used in the present invention has a size of 1–50 nm as a thickness and 1–20 $\mu$m as a face size. The face size used herein means a diameter of a circle having the same area of a face of each mica piece, and the thickness is an average thickness of each mica piece. For control of diffusion, a smaller thickness is more preferred, and a larger face size is more preferred so long as planarity and transparency of coated surface are not degraded. Therefore, the mean aspect ratio is 100 or more, preferably 200 or more, particularly preferably 500 or more. Although the upper limit of the aspect ratio is not particularly limited, it is about 100,000. Preferred sizes of other swellable inorganic stratifying compounds are similar to those of swellable synthetic mica and bentonite, and the mean aspect ratio is preferably 100 or more, more preferably 200 or more. Although the upper limit of the aspect ratio is not particularly limited, it is about 100,000.

The amount of the swellable inorganic stratifying compound used for the present invention is preferably 5–5000 $mg/m^2$, more preferably 50–500 $mg/m^2$. The amount can be arbitrarily selected depending on the purpose. Since surfaces of the swellable inorganic stratifying compound used for the present invention are negatively charged, it is not preferable to add a polymer having a cationic site or cationic surfactant to the same layer. As a binder used in the layer containing the swellable inorganic stratifying compound used for the present invention, there can be used gelatin, derivatives of gelatin, graft polymers of gelatin and other polymers, proteins such as albumin and casein; cellulose derivatives such as hydroxyethylcellulose, carboxymetholcellulose and cellulose sulfate, sodium alginate, derivatives of saccharides such as derivatives of starch; various synthetic hydrophilic polymers including homopolymers and copolymers such as polyvinyl alcohol, polyvinyl alcohol partial acetal, polyvinyl-N-pyrrolidone, polyacrylic acid, polymethacrylic acid and polyacrylamide, various kinds of polymer latex and so forth. Among these, polyvinyl alcohol and polymer latex are preferred.

Examples of polyvinyl alcohol preferably used for the present invention include PVA-205, PVA-217, PVA-217E, PVA-224, PVA-235, PVA-117, PVA-124, Poval R1130, Exceval HR produced by Kuraray Co., Ltd. and so forth.

Examples of polymer species used for the polymer latex include acrylic resin, polyvinyl acetate resin, polyester resin, polyurethane resin, rubber resin, polyvinyl chloride resin, polyvinylidene chloride resin and polyolefin resin, copolymers of monomers constituting these resins and so forth. The polymers may be linear, branched or crosslinked. They may be so-called homopolymers in which a single kind of monomers are polymerized, or copolymers in which two or more different kinds of monomers are polymerized. The copolymers may be random copolymers or block copolymers. The polymers may have a number average molecular weight of about 5,000–1,200,000, preferably from about 10,000–100,000. Polymers having a too small molecular weight may unfavorably suffer from insufficient mechanical strength of films, and those having a too large molecular weight may unfavorably suffer from bad film forming property.

Specific examples of the polymer latex preferably used for the present invention include latex of methyl methacrylate/ethyl acrylate/methacrylic acid copolymer, latex of methyl methacrylate/butadiene/itaconic acid copolymer, latex of ethyl acrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chloride/ethyl acrylate/acrylonitrile/methacrylic acid copolymer and so forth. More specifically, there can be mentioned latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate (95 weight %)/methacrylic acid (5 weight %) copolymer and so forth. Such polymers are also commercially available, and examples thereof include acrylic resins such as CEBIAN A-4635, 46583, 4601 (all produced by Dicel Kagaku Kogyo Co., Ltd), Nipol LX 811, 814, 821, 820, 857 (all produced by Nippon Zeon Co., Ltd.), VONCORT R3340, R3360, R3370, 4280 (all produced by Dai-Nippon Ink & Chemicals, Inc.); polyester resins such as FINETEX ES 650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber resins such as LACSTAR 7310K, 3307B, 4700H, 7132C (all produced by Dai-Nippon Ink & Chemicals, Inc.), Nipol LX 410, 430, 435, 438C (all produced by Nippon Zeon Co., Ltd.); polyvinyl chloride resins such as G351, G576 (both produced by Nippon Zeon Co., Ltd.); polyvinylidene chloride resins such as L502, L513 (both produced by Asahi Chemical Industry Co., Ltd.), ARON D7020, D504 and D5071 (all produced by Mitsui Toatsu Co., Ltd.); and olefin resins such as CHEMIPEARL S120 and SA10 (both produced by Mitsui Petrochemical Industries, Ltd.) and so forth. These polymers may be used individually or, if desired, as a blend of two or more of them.

Since the swellable synthetic mica used for the present invention has a refractive index of about 1.53, the binder used together is preferably a polymer having a refractive index of a similar order. The weight ratio of the swellable inorganic stratifying compound/binder in the layer containing the swellable inorganic stratifying compound is preferably 1/20–100/1, more preferably 1/10–10/1, further preferably 1/5–5/1.

Hereafter, the method for dispersing the swellable inorganic stratifying compound used for the present invention will be described. Usually, 5–10 weight parts of the swellable inorganic stratifying compound is added to 100 weight parts of water, taken to water sufficiently, swollen and dispersed by using a dispersing apparatus. Examples of dispersing apparatuses used use in the present invention include various kinds of mills directly applying mechanical force, high speed stirring type dispersing apparatuses exerting strong shearing force, dispersing apparatuses exerting extremely high ultrasonic energy and so forth. Specific examples include ball mill, sand grinder mill, visco mill, colloid mill, homogenizer, dissolver, Polytron, homomixer, homoblender, Keddy mill, jet agitator, capillary type emulsifying apparatus, liquid siren, electromagnetic skewing ultrasonic wave generator, emulsifying apparatus equipped with a Paulman whistle and so forth. A 5–10 weight % dispersion dispersed by any of the aforementioned methods has high viscosity or is in a gel state and shows extremely good storage stability. When this dispersion is added to a coating solution, it is diluted with water, sufficiently stirred and then added.

Since the surface of the swellable inorganic stratifying compound used in the present invention is negatively charged, adsorption of a cationic surfactant onto the surface makes the surface hydrophobic. When such a swellable inorganic stratifying compound having a hydrophobic surface is used, the compound is swollen with a solvent showing sufficient affinity for the hydrophobic portion of the cationic surfactant adsorbed onto the surface, then dispersed and added with a binder solution to prepare a coating solution.

Although the layer to which the swellable inorganic stratifying compound used for the present invention is incorporated is not particularly limited, it is preferably, as a layer formed on the emulsion layer side of the support, an undercoat layer between the emulsion layer and the support or an intermediate layer, or as a layer formed on the side of the support opposite to the emulsion layer side, for example, a surface protective layer, a layer between a protective layer and the support (back layer), an intermediate layer, an undercoat layer or the like. Among these, a back layer, an intermediate layer between the back layer and the support and an undercoat layer are preferred.

The thickness of the layer to which the swellable inorganic stratifying compound used for the present invention is incorporated may be such a thickness that change of the length of the support due to moisture absorption or dehydration of the support should be suppressed, and it is usually 0.3–10 $\mu$m, preferably 0.5–5 $\mu$m.

Although any hydrazine compound having an onium group in the molecule can be used for the silver halide photographic light-sensitive material of the present invention, it is preferably a compound represented by the aforementioned formula (1) or (2).

In the formula (1), the arylene group represented by $R^1$ is a substituted or unsubstituted arylene group having preferably 6–30 carbon atoms, more preferably 6–20 carbon atoms, in total. Examples include a phenylene group, a naphthylene group and so forth, and a phenylene group is particularly preferred. The divalent heterocyclic group represented by $R^1$ is a substituted or unsubstituted 5- or 6-membered aromatic heterocyclic ring containing at least one of N, O and S and preferably 2–30 carbon atoms, more preferably 2–20 carbon atoms, in total. Examples include pyridine, pyrimidine, oxazole, thiazole, quinoline, isoquinoline and so forth, and pyridine is particularly preferred.

$R^1$ may have one or more substituents. Examples of the substituent include, for example, a halogen atom (fluorine atom, chlorine atom, bromine atom or iodine atom), an alkyl group (linear, branched or cyclic alkyl group, including a bicycloalkyl group and an active methine group), an alkenyl group, an alkynyl group, an aryl group, a heterocyclic group (substitution position is not particularly limited), an acyl group, an alkoxycarbonyl group, an aryloxycarbonyl group, a heterocyclyloxycarbonyl group, a carbamoyl group, an N-hydroxycarbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxy group or a salt thereof, an oxalyl group, an oxamoyl group, a cyano group, a carbonimidoyl group, a formyl group, a hydroxy group, an alkoxyl group (including a group containing a repeating unit of ethyleneoxy group or propyleneoxy group), an aryloxy group, a heterocyclyloxy group, an acyloxy group, an (alkoxy or aryloxy)carbonyloxy group, a carbamoyloxy group, a sulfonyloxy group, an amino group, an (alkyl, aryl or heterocyclyl) amino group, an acylamino group, a sulfonamido group, a ureido group, a thioureido group, an N-hydroxyureido group, an imido group, an (alkoxyl or aryloxy)carbonylamino group, a sulfamoylamino group, a semicarbazido group, a thiosemicarbazido group, a hydrazino group, an ammonio group, an oxamoylamino group, an N-(alkyl or aryl)sulfonylureido group, an N-acylureido group, an N-acylsulfamoylamino group, a hydroxyamino group, a nitro group, an isocyano group, an imino group, a mercapto group, an (alkyl, aryl or heterocyclyl)thio group, an (alkyl, aryl or heterocyclyl) dithio group, an (alkyl or aryl)sulfonyl group, an (alkyl or aryl) sulfinyl group, a sulfo group or a salt thereof, a sulfamoyl group, an N-acylsulfamoyl group, an N-sulfonylsulfamoyl group or a salt thereof, a phosphino group, a phosphinyl group, a phosphinyloxy group, a phosphinylamino group, a silyl group and so forth. The active methine group means a methine group substituted with two of electron-withdrawing groups. The electron-withdrawing group herein used means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. Two of the electron-withdrawing groups may bond to each other to form a ring. Further, a salt means a compound containing a cation such as cations of alkali metals, alkaline earth metals and heavy metals or an organic cation such as ammonium ions and phosphonium ions. These substituents may be further substituted with these substituents. When two or more of these groups exist, they may be identical or different, and the substituents may bond to each other to form a ring.

$R^1$ in the formula (1) is preferably an arylene group, more preferably a phenylene group, particularly preferably an unsubstituted phenylene group.

In the formulas (1) and (2), Q represents an onium group, and examples include onium groups of nitrogen atom, phosphorus atom and sulfur atom. It is preferably a group represented by any of the following formulas (3) to (7).

Formula (3) to (7)

(3)

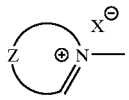

(4)

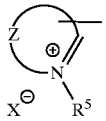

(5)

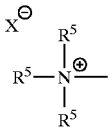

(6)

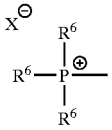

(7)

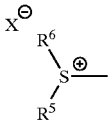

In the formulas (3) to (7), $R^5$ represents a substituted or unsubstituted aliphatic group, aryl group or heterocyclic group, Z represents an atomic group required to form a nitrogen-containing heteroaromatic ring together with a nitrogen atom in the formula, and $X^-$ represents an counter anion.

In the formulas (4) to (7), the aliphatic group represented by $R^5$ preferably a linear, branched or cyclic substituted or unsubstituted alkyl group, alkenyl group or alkynyl group having preferably 1–30 carbon atoms, more preferably 1–20 carbon atoms, in total. Examples include methyl group, ethyl group, hexyl group, 2-ethylhexyl group, benzyl group, dodecyl group, stearoyl group, 4-chlorobutyl group, cyclohexyl group, tert-butyl group, ethenyl group, ethynyl group and so forth, and preferred is an alkyl group. The aryl group represented by $R^5$ is a substituted or unsubstituted aryl group having preferably 6–30 carbon atoms, more preferably 6–20 carbon atoms, in total. Examples include phenyl group, 4-cyanophenyl group, 4-butylphenyl group, 2-naphthyl group and so forth, and particularly preferred is phenyl group. The heterocyclic group represented by $R^5$ is a substituted or unsubstituted 5- or 6-membered aromatic or non-aromatic heterocyclic ring containing at least one of N, O and S, preferably a nitrogen-containing heteroaromatic ring (e.g., pyridine ring, quinoline ring, isoquinoline ring, imidazole ring etc.). $R^5$ may be further substituted with one or more other substituents, and the substituents can be selected from the groups mentioned as the substituents of $R^1$ in the formula (1). $R^5$ is more preferably an aliphatic group or an aryl group, particularly preferably an alkyl group or a phenyl group. Further, $R^5$ in the formulas (5) to (7) may be identical or different, and may bond to each other to form a ring.

In the formulas (3) and (4), the nitrogen-containing heteroaromatic ring formed by Z and the nitrogen atom is preferably a 5- or 6-membered substituted or unsubstituted nitrogen-containing heteroaromatic ring. This may be condensed to another ring (e.g., benzene ring, naphthalene ring, pyridine ring, thiophene ring, furan ring, pyrrole ring etc.). Examples of this nitrogen-containing heteroaromatic ring include oxazole ring, benzoxazole ring, thiazole ring, benzothiazole ring, pyridine ring, pyrimidine ring, quinoline ring, isoquinoline ring, quinazoline ring, acridine ring, imidazole ring, benzimidazole ring and so forth, preferred are pyridine ring, quinoline ring and isoquinoline ring, and particularly preferred is pyridine ring. Z may have one or more substituents, and for example, those mentioned as the substituents of $R^1$ in the formula (1) can be used.

In the formulas (1) and (2), Q is more preferably a group represented by the formula (3), (4) or (6), particularly preferably a group represented by the formula (3) or (4).

$X^-$ represents a counter anion, and examples include, for example, a halogen ion (chlorine, bromine, iodine etc.), a carboxylate ion (trifluoroacetate, pentachlorobenzoate etc.). a sulfonate ion (methanesulfonate, toluenesulfonate etc.), a sulfate ion, a perchlorate ion, a carbonate ion, a nitrate ion, a boron tetrafluoride ion, $PF^{6-}$ etc. Preferred are a halogen ion, a carboxylate ion and a sulfonate ion. When $X^-$ forms an intramolecular salt, it represents a counter anion portion.

In the formulas (1) and (2), the divalent bridging group represented by J is a group consisting of —$CH_2$—, —CH=CH—, —C=C—, —$C_6H_4$—, —NH—, —O—, —S—, —CO—, —SO—, —$SO_2$—, —PO—, —CH=N— or a combination of these bridging groups. Examples of the combination include —CONH—, —$SO_2$NH—, —NHCONH—, —CONH$SO_2$—, —COO—, —($CH_2CH_2O$)n— (n=1–10), —$CH_2O$—, —($CH_2$)n— (n=2–20), —$CH_2$—$C_6H_4$— (bonding at any of o, m and p-position), combinations of these and combinations of these and the aforementioned bridging groups.

In the formula (1), it is particularly preferred that the atom in J directly bonding to $R^1$ is not a nitrogen atom.

In the formulas (1) and (2), the bridging group represented by J has preferably 1–20 carbon atoms, more preferably 2–10 carbon atoms, in total. These bridging groups may have one or more substituents instead of hydrogen atoms, and as the substituents, those mentioned as the substituents of $R^1$ in the formula (1) can be used. A particularly preferred bridging group represented by J is an alkylene group.

In the formulas (1) and (2), $G^1$ represents —CO—, —$SO_2$—, —SO—, —COCO—, thiocarbonyl group, iminomethylene group or —P(O)($G^2R^4$)—, where $G^2$ represents a single bond, —O— or —$NR^4$—, and $R^4$ represents a hydrogen atom, an aliphatic group, an aryl group or a heterocyclic group.

In the formula (1), $R^2$ represents a hydrogen atom, an alkyl group (preferably a linear, branched or cyclic substituted or unsubstituted alkyl group having 1–10 carbon atoms in total, for example, methyl group, difluoromethyl group, trifluoromethyl group, dichloromethyl group, pentafluoroethyl group, benzyl group, o-hydroxybenzyl group, methoxymethyl group, benzenesulfonylmethyl group, hydroxymethyl group, benzenesulfonylaminomethyl group, —$CF_2CF_2COOK$ etc.), an aryl group (preferably a substituted or unsubstituted aryl group having 6–20 carbon atoms in total, for example, phenyl group, hydroxymethylphenyl group, chlorophenyl group etc.), a heterocyclic group (preferably a substituted or unsubstituted 5- or 6-membered aromatic or non-aromatic heterocyclic ring containing at least one of N, O and S, for example, pyridyl group, thienyl group, furyl group, imidazolyl group, piperidyl group, pyrrolidyl group etc.), an alkoxyl group (preferably a substituted or unsubstituted alkoxyl group having 1–10 carbon atoms in total, for example, methoxy group, ethoxy group, butoxy group etc.), an aryloxy group (preferably a substituted or unsubstituted aryloxy group having 6–20 carbon atoms in total, for example, phenoxy group etc.), an amino group (preferably a substituted amino group having 1–10 carbon atoms in total, for example, methylamino group, dimethylamino group, phenylamino group etc.) or a carbamoyl group. $R^2$ may have one or more substituents, and as the substituents, those mentioned as the substituents of $R^1$ can be used.

In the formula (1), it is more preferred that the group represented by $G^1$ is —CO—, and the group represented by $R^2$ is an alkyl group that does not contain an onium group or a carbamoyl group that does not contain an onium group. In the formula (1), the group represented by —$G^1$—$R^2$ is particularly preferably —$COCF_2H$ or —$COCF_2CF_2COOM$ (M represents a hydrogen atom or an counter cation).

In the formula (2), the aryl group represented by $R^3$ is a substituted or unsubstituted aryl group having preferably 6–30 carbon atoms, more preferably 6–20 carbon atoms, in total, for example, a phenyl group, a naphthyl group etc., particularly preferably a phenyl group. The heterocyclic group represented by $R^3$ is a substituted or unsubstituted 5- or 6-membered aromatic heterocyclic ring containing at least one of N, O and S, for example, pyridine ring, pyrimidine ring, oxazole ring, thiazole ring, quinoline ring, isoquinoline ring or the like, particularly preferably pyridine ring. $R^3$ is preferably an aryl group, and a phenyl group is most preferred. $R^3$ may have one or more substituents, and as the substituents, those mentioned as the substituents of $R^1$ can be used.

In the formulas (1) and (2), both of $A^1$ and $A^2$ represent a hydrogen atom, or one of them represents a hydrogen atom, and the other represents an acyl group (e.g., acetyl group, benzoyl group etc.), a sulfonyl group (e.g., methanesulfonyl group, toluenesulfonyl group etc.) or an oxalyl group (e.g., ethoxyalyl group etc.). It is particularly preferred that both of $A^1$ and $A^2$ represent a hydrogen atom.

The hydrazine compound having an onium group in the molecule used in the present invention is preferably a compound represented by the formula (1).

The compounds represented by the formula (1) or (2) have preferably 10–200 carbon atoms, more preferably 13–100 carbon atoms, particularly preferably 15–50 carbon atoms, in total. Further, a plurality of the compounds of represented by the formula (1) or (2) may be bond together through a bridging group to form a bis-compound or tris-compound, or a polymer structure having an average molecular weight of 500,000 or less.

The compounds represented by the formula (1) or (2) may contain an absorptive group capable of being absorbed onto silver halide. Examples of the absorptive group include an alkylthio group, an arylthio group, a thiourea group, a thioamido group, a mercaptoheterocyclic group, a triazole group and so forth, described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246. Further, these groups capable of being absorbed onto silver halide may be modified into a precursor thereof. Examples of the precursor include those groups described in JP-A-2-285344.

The compounds represented by the formula (1) or (2) may contain a ballast group or polymer that is usually used for immobile photographic additives such as couplers. In particular, those incorporated with a ballast group are preferred examples. The ballast group is a group relatively inert to photographic properties and having 8 or more carbon atoms, and can be selected from, for example, an alkyl group, an aralkyl group, an alkoxy group, a phenyl group, an alkylphenyl group, a phenoxy group, an alkylphenoxy group and so forth. Examples of the polymer include those described in, for example, JP-A-1-100530.

The compounds represented by the formula (1) or (2) may contain a group containing a repeating unit of ethyleneoxy group or propyleneoxy group, an (alkyl, aryl or heterocyclyl)thio group or a dissociable group that can be dissociated with a base (a carboxy group, a sulfo group, an acylsulfamoyl group, a carbamoylsulfamoyl group etc.). In particular, those having a group containing a repeating unit of ethyleneoxy group or propyleneoxy group or an (alkyl, aryl or heterocyclyl)thio group are preferred examples.

Specific examples of the compounds of the formula (1) or (2) include, for example, those described as specific examples in U.S. Pat. No. 4,994,365, JP-A-5-45761, JP-A-5-34853, 5-45762, JP-A-5-45763, JP-A-5-45764, JP-A-5-150392, JP-A-5-204075, JP-A-5-204076, JP-A-5-216151, JP-A-5-333466, JP-A-6-19032, JP-A-6-19031, JP-A-6-148777, JP-A-6-148778, JP-A-6-161010, JP-A-6-175253, JP-A-10-232456, JP-A-11-190887, German Patent Nos. 3829078, 4006032 and JP-A-4-96035.

Specific examples of the compounds represented by the formula (1) or (2) are illustrated below. However, the compounds represented by the formula (1) or (2) that can be used for the present invention are not limited to the following compounds.

(A-1)
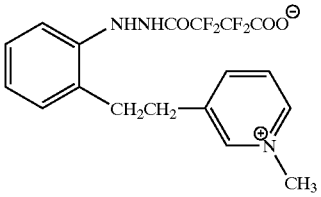
(A-2)
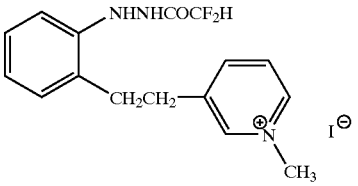
(A-3)
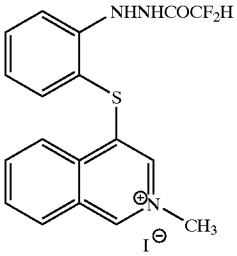
(A-4)
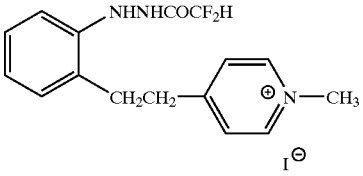
(A-5)
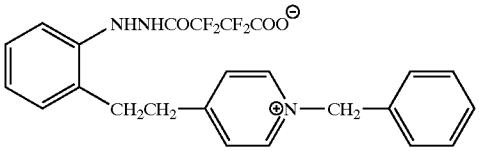
(A-6)
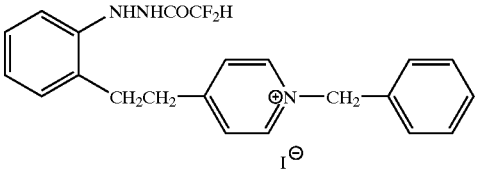
(A-7)
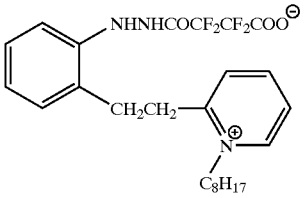
(A-8)
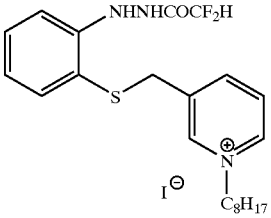
(A-9)
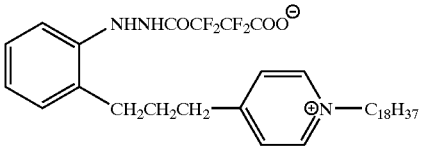
(A-10)
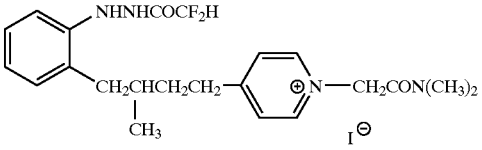
(A-11)
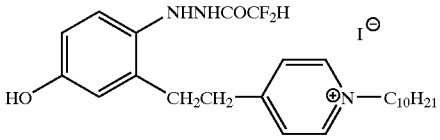
(A-12)
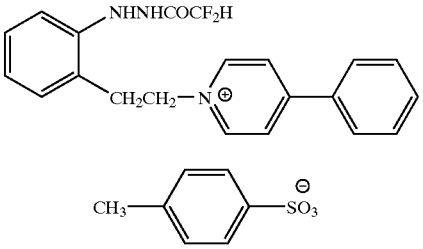
(A-13)
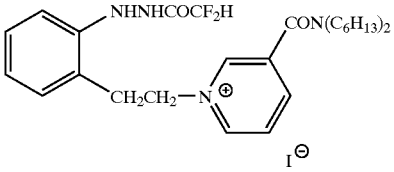
(A-14)
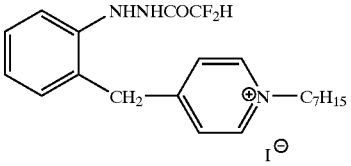

-continued
(A-15)
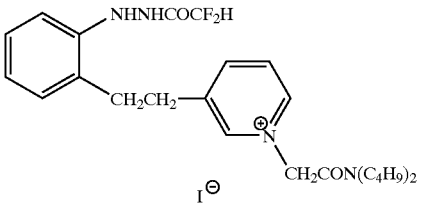
(A-16)
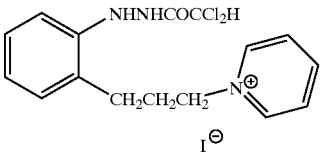
(A-17)
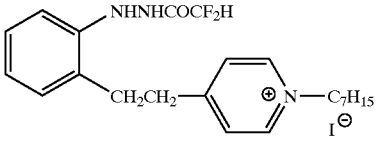
(A-18)
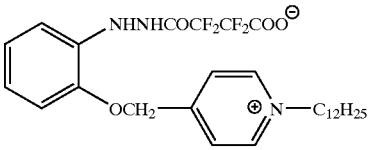
(A-19)
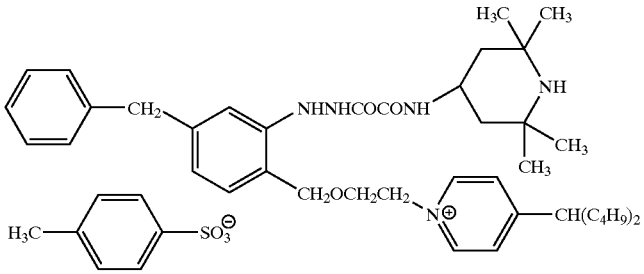
(A-20)
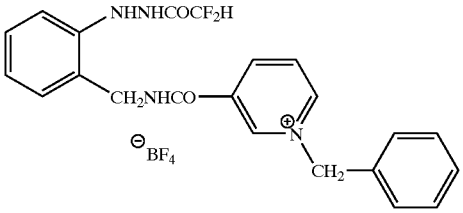
(A-21)
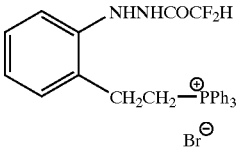
(A-22)
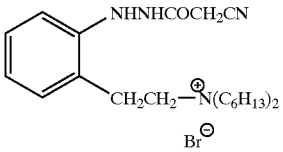
(A-23)
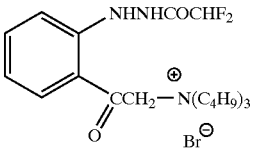
(A-24)
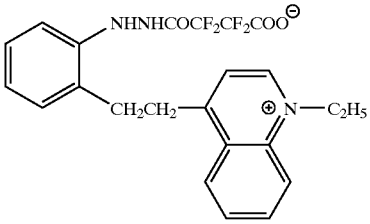
(A-25)
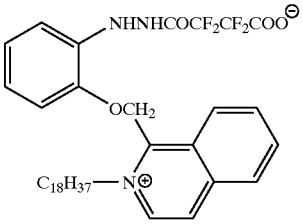
(A-27)
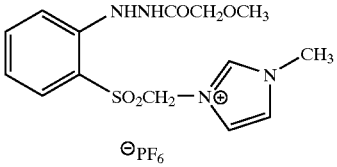
(A-26)
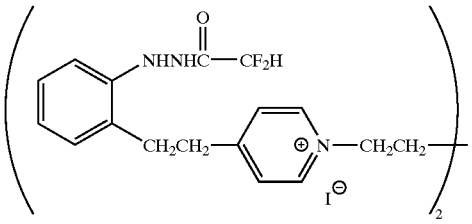

-continued
(A-28)
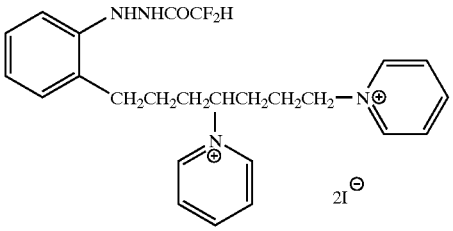
(A-29)
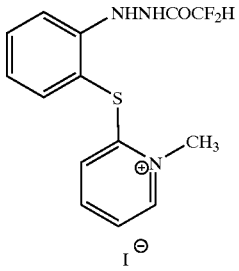
(A-30)
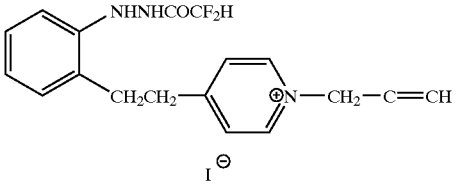
(A-31)
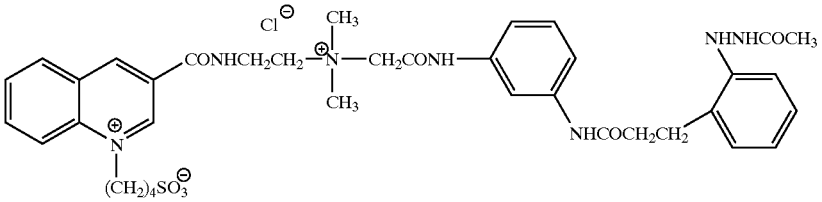
(A-32)
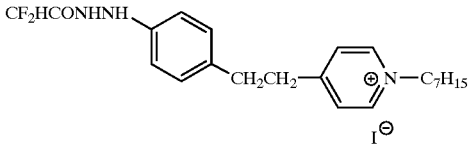
(A-33)
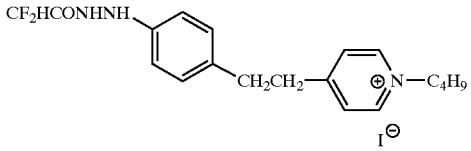
(A-34)
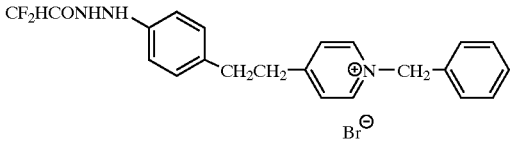
(A-35)
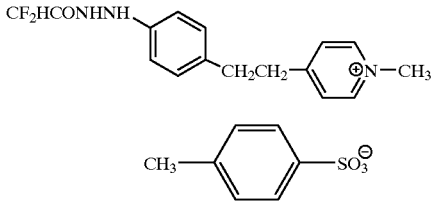
(A-36)
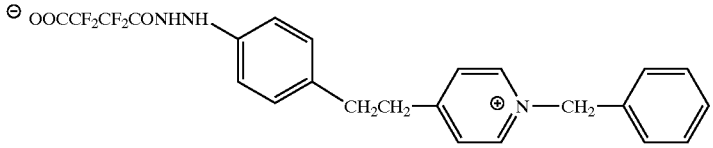
(A-37)
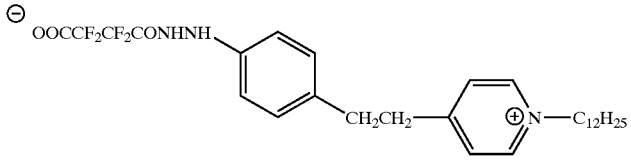
(A-38)
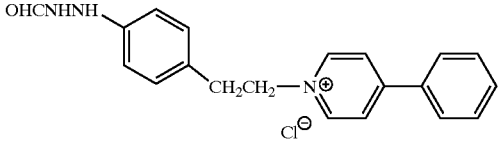
(A-39)
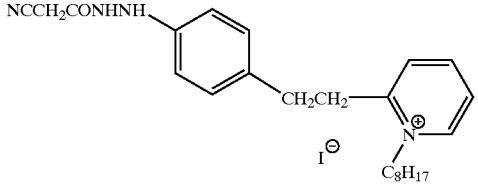

-continued
(A-40)
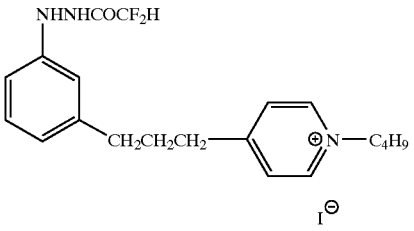
(A-41)
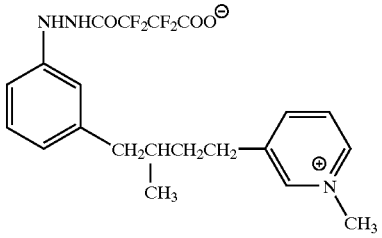
(A-42)
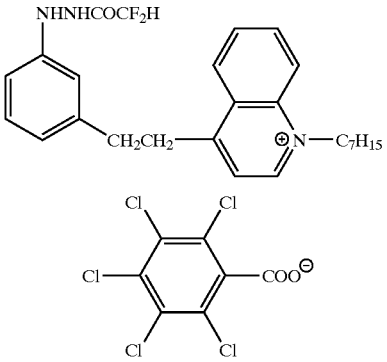
(A-43)
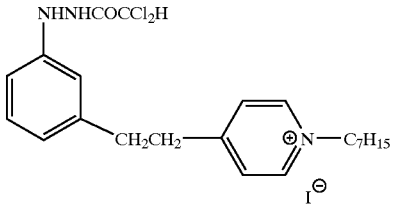
(A-44)
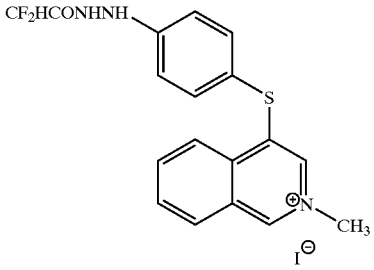
(A-45)
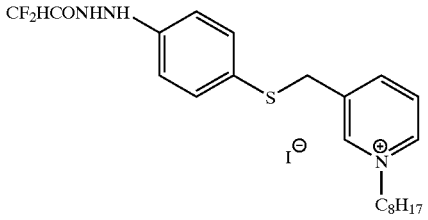
(A-46)
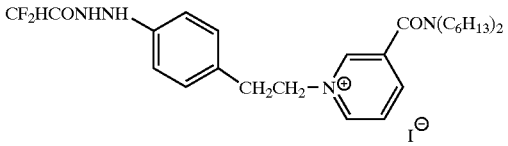
(A-47)
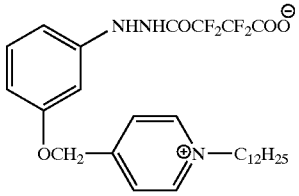
(A-48)
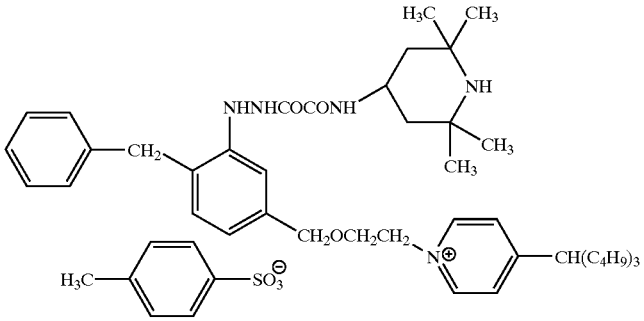

-continued
(A-49)
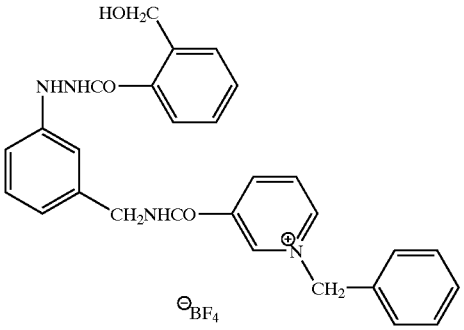
(A-50)
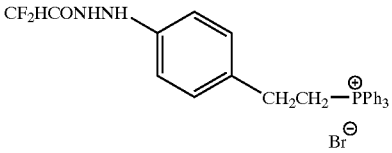
(A-51)
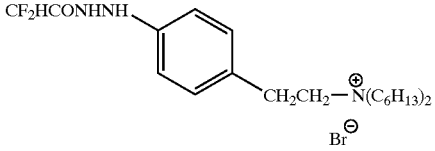
(A-52)
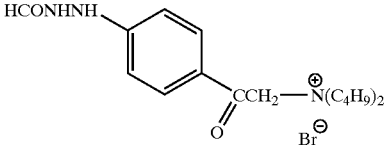
(A-53)
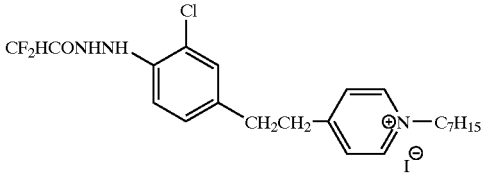
(A-54)
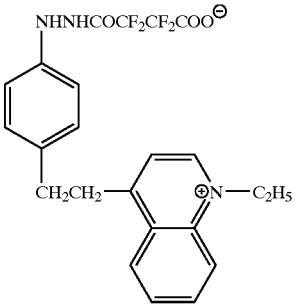
(A-55)
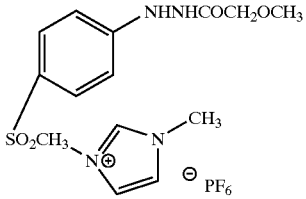
(A-56)
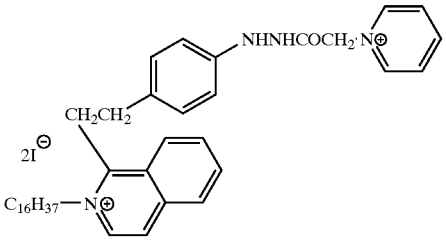
(A-57)
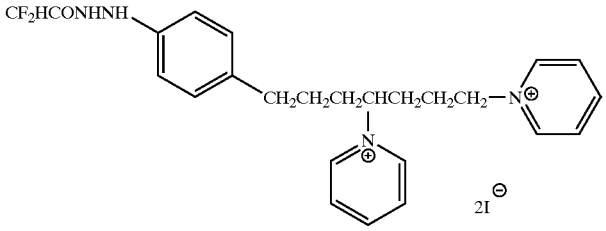
(A-58)
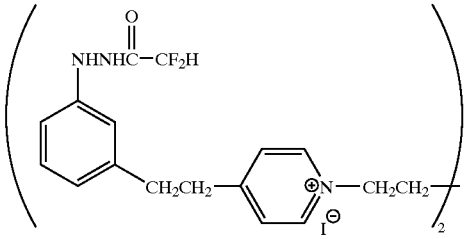
(A-59)
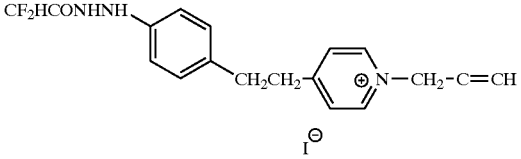

-continued
(A-60)
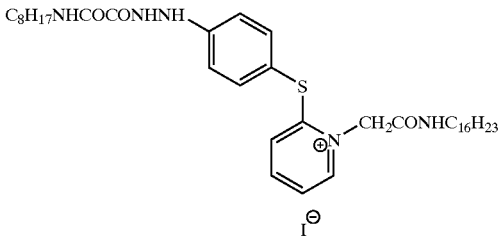
(A-61)
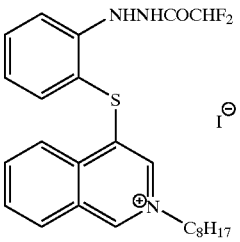
(A-62)
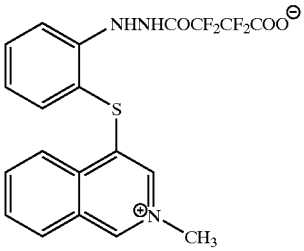
(A-63)
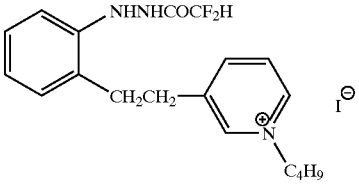
(A-64)
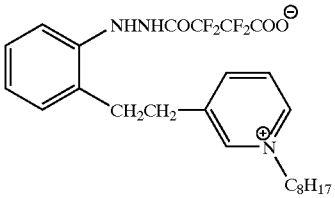
(A-65)
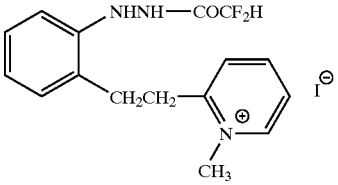
(A-66)
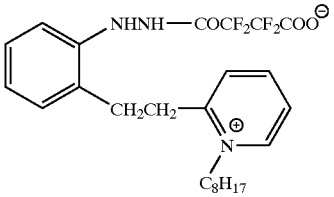
(A-67)
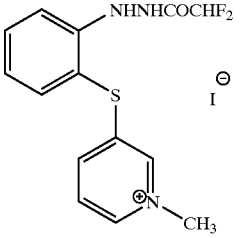
(A-68)
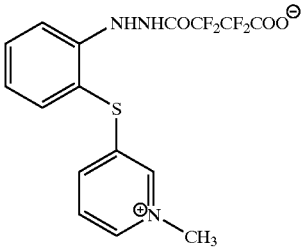
(A-69)
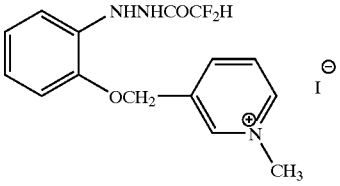
(A-70)
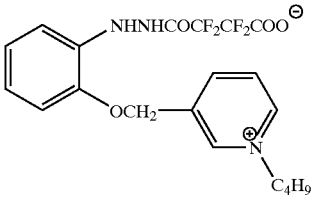
(A-71)
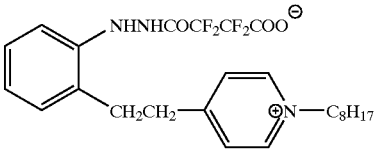

-continued (A-72)

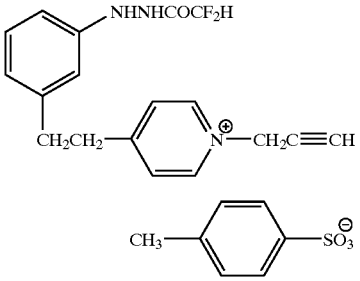

(A-73)

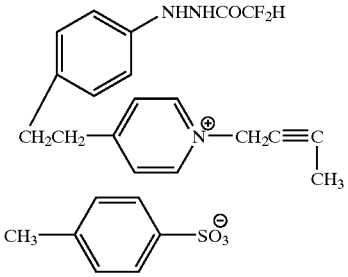

(A-74)

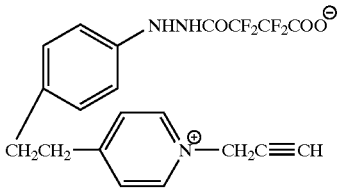

(A-75)

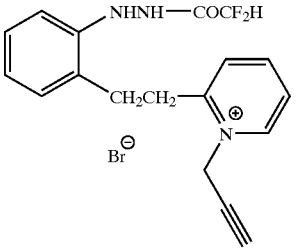

(A-76)

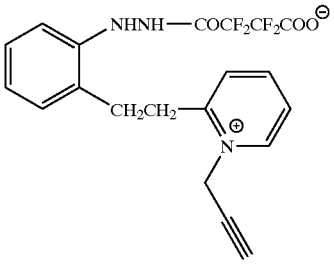

(A-77)

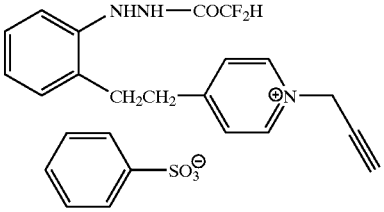

(A-78)

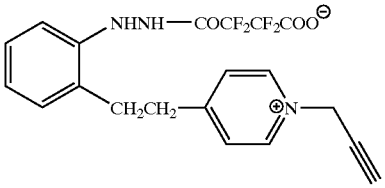

(A-79)

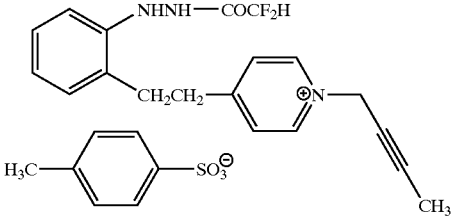

(A-80)

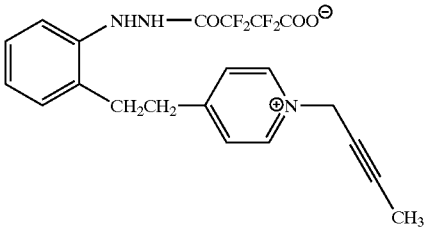

(A-81)

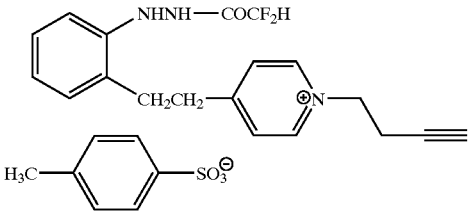

(A-82)

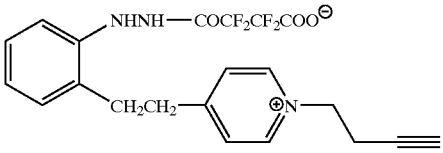

In the present invention, the hydrazine compounds having an onium group in the molecules may be dissolved in an appropriate water-miscible organic solvent, such as an alcohol (e.g., methanol, ethanol, propanol, fluorinated alcohol), ketone (e.g., acetone, methyl ethyl ketone), dimethylformamide, dimethyl sulfoxide, methyl cellosolve or the like, before use.

The hydrazine compounds having an onium group in the molecules may also be dissolved in an oil such as dibutyl phthalate, tricresyl phosphate, glyceryl triacetate or diethyl phthalate using an auxiliary solvent such as ethyl acetate or cyclohexanone and mechanically processed into an emulsion dispersion by a conventionally well-known emulsion dispersion method before use. Alternatively, powder of hydrazine compounds having an onium group in the molecules may also be dispersed in water by means of ball mill, colloid mill or ultrasonic waves according to a method known as solid dispersion method and used.

In the present invention, the hydrazine compounds having an onium group in the molecule may be added to any layer on the silver halide emulsion layer side of the support. For example, it can be added to a silver halide emulsion layer or another hydrophilic colloid layer. However, it is preferably added to a silver halide emulsion layer or a hydrophilic colloid layer adjacent thereto. Further, two or more kinds of hydrazine compounds having an onium group in the molecules may be used in combination.

The addition amount of the hydrazine compound having an onium group in the molecule in the present invention is preferably $1\times10^{-5}$ to $1\times10^{-2}$ mol, more preferably $1\times10^{-5}$ to $5\times10^{-3}$ mol, most preferably from $2\times10^{-5}$ to $5\times10^{-3}$ mol, per mol of silver halide.

As silver halide of the silver halide emulsion used for the silver halide photographic light-sensitive material of the present invention, silver bromide, silver chlorobromide or silver chloroiodobromide is preferably used. In particular, silver chlorobromide or silver chloroiodobromide having a silver bromide content of 20–75 mol % is preferably used. The form of silver halide grain may be any of cubic, tetradecahedral, octahedral, variable and tabular forms, but a form having an aspect ratio (diameter as circle/thickness) of 2 or less is preferred, and a cubic form is most preferred. The silver halide grains preferably have a mean grain size of 0.03–0.5 $\mu$m, more preferably 0.05–0.3 $\mu$m, and preferably has a narrow grain size distribution in terms of a variation coefficient, which is represented as {(Standard deviation of grain size)/(mean grain size)}×100, of preferably 15% or less, more preferably 10% or less.

The silver halide grains may have uniform or different phases for the inside and the surface layer. Further, they may have a localized layer having a different halogen composition inside the grains or as surface layers of the grains.

The photographic emulsion used for the present invention can be prepared by using the methods described in P. Glafkides, Chimie et Physique Photographique, Paul Montel (1967); G. F. Duffin, Photographic Emulsion Chemistry, The Focal Press (1966); V. L. Zelikman et al, Making and Coating Photographic Emulsion, The Focal Press (1964) and so forth.

That is, any of an acidic process and a neutral process may be used. In addition, a soluble silver salt may be reacted with a soluble halogen salt by any of the single jet method, double jet method and a combination thereof. A method of forming grains in the presence of excessive silver ions (so-called reverse mixing method) may also be used.

As one type of the double jet method, a method of maintaining the pAg constant in the liquid phase where silver halide is produced, that is, the so-called controlled double jet method, may also be used. Further, it is preferable to form grains using the so-called silver halide solvent such as ammonia, thioether or tetra-substituted thiourea. More preferred as the silver halide solvent is a tetra-substituted thiourea compound, and it is described in JP-A-53-82408 and JP-A-55-77737 Preferred examples of the thiourea compound include tetramethylthiourea and 1,3-dimethyl-2-imidazolidinethione. While the amount of the silver halide solvent to be added may vary depending on the kind of the compound used, the desired grain size and halide composition of silver halide to be desired, it is preferably in the range of from $10^{-5}$ to $10^{-2}$ mol per mol of silver halide.

According to the controlled double jet method or the method of forming grains using a silver halide solvent, a silver halide emulsion comprising regular crystal form grains and having a narrow grain size distribution can be easily prepared, and these methods are useful for preparing the silver halide emulsion used for the present invention.

In order to achieve a uniform grain size, it is preferable to rapidly grow grains within the range of not exceeding the critical saturation degree by using a method of changing the addition rate of silver nitrate or alkali halide according to the grain growth rate as described in British Patent No. 1,535,016, Japanese Patent Publication (Kokoku, henceforth referred to as "JP-B") No. 48-36890 and JP-B-52-16364, or a method of changing the concentration of the aqueous solution as described in U.S. Pat. No. 4,242,445 and JP-A-55-158124.

The silver halide emulsion used for the present invention preferably contains a metal complex having one or more cyanide ligands in an amount of $1\times10^{-6}$ mol or more, more preferably $5\times10^{-6}$ to $1\times10^{-2}$ mol, particularly preferably $5\times10^{-6}$ to $5\times10^{-3}$ mol, in the silver halide per mol of silver.

The metal complex having one or more cyanide ligands used for the present invention is added in the form of a water-soluble complex salt. Particularly preferred complexes include hexa-coordinated complexes represented by the following formula:

$$[M(CN)_{n1}L_{6-n1}]^{n-}$$

In the formula, M represents a metal belonging to any one of Groups V to VIII, and Ru, Re, Os and Fe are particularly preferred. L represents a ligand other than cyanide, and halide ligand, nitrosyl ligand, thionitrosyl ligand and so forth are preferred. n1 represents an integer of 1–6, and n represents 0, 1, 2, 3 or 4. n1 is preferably 6. In these compounds, the counter ion does not play any important role, and an ammonium ion or alkali metal ion is used.

Specific examples of the complexes used for the present invention are mentioned below. However, complexes that can be used for the present invention are not limited to these.

| | |
|---|---|
| $[Re(NO)(CN)_5]^{2-}$ | $[Re(O)_2(CN)_4]^{3-}$ |
| $[Os(NO)(CN)_5]^{2-}$ | $[Os(CN)_6]^{4-}$ |
| $[Os(O)_2(CN)_4]^{4-}$ | |
| $[Ru(CN)_6]^{4-}$ | $[Fe(CN)_6]^{4-}$ |

The metal complex used for the present invention may present at any site of silver halide grains so long as it exists in silver halide grains. When silver halide crystals have a structure comprising a surface layer and a core, it preferably exists in the core. In particular, when the core contains 99 mol % or less, preferably 0–95 mol %, of silver of the silver halide crystals, it is preferred that the metal complex exists in the core.

The silver halide emulsion used for the present invention preferably contains, besides the metal complex having one or more cyanide ligands, a rhodium compound, iridium compound, rhenium compound, ruthenium compound, osmium compound or the like in order to achieve high contrast and low fog.

As the rhodium compound used for the present invention, a water-soluble rhodium compound can be used. Examples thereof include rhodium(III) halide compounds and rhodium complex salts having a halogen, amine, oxalato, aquo or the like as a ligand, such as hexachlororhodium(III) complex salt, pentachloroaquorhodium complex salt, tetrachlorodiaquorhodium complex salt, hexabromorhodium(III) complex salt, hexaaminerhodium(III) complex salt and trioxalatorhodium(III) complex salt. The rhodium compound is dissolved in water or an appropriate solvent prior to use, and a method commonly used for stabilizing the rhodium compound solution, that is, a method of adding an aqueous solution of hydrogen halide (e.g., hydrochloric acid, hydrobromic acid or hydrofluoric acid) or an alkali halide (e.g. KCl, NaCl, Kfr or NaBr), may be used. In place of using a water-soluble rhodium, separate silver halide grains that have been previously doped with rhodium may be added and dissolved at the time of preparation of silver halide.

The rhenium, ruthenium or osmium compound used for the present invention is added in the form of a water-soluble complex salt described in JP-A-63-2042, JP-A-1-285941, JP-A-2-20852, JP-A-2-20855 and so forth. Particularly preferred examples are six-coordinate complex salts represented by the following formula:

$$[ML_6]^{n-}$$

In the formula, M represents Ru, Re or Os, L represents a ligand, and n represents 0, 1, 2, 3 or 4. In this case, the counter ion plays no important role and an ammonium or alkali metal may be used. Preferred examples of the ligand include a halide ligand, a nitrosyl ligand, a thionitrosyl ligand and so forth. Specific examples of the complex that can be used for the present invention are shown below. However, the complexes that can be used for the present invention are not limited to these examples.

| | |
|---|---|
| $[ReCl_6]^{3-}$ | $[ReBr_6]^{3-}$ |
| $[ReCl_5(NO)]^{2-}$ | $[Re(NS)Br_5]^{2-}$ |
| $[RuCl_6]^{3-}$ | $[RuC1_4(H_2O)_2]^{-}$ |
| $[RuCl_5(NO)]^{2-}$ | $[RuBr_5(NS)]^{2-}$ |
| $[Ru(CO)_3C1_3]^{2-}$ | $[Ru(CO)Cl_5]^{2-}$ |
| $[Ru(CO)Br_5]^{2-}$ | $[OsCl_6]^{3-}$ |
| $[OsCl_5(NO)]^{2-}$ | $[OsNS)Br_5]^{2-}$ |

The amount of these compounds is preferably $1\times10^{-9}$ to $1\times10^{-5}$ mol, particularly preferably $1\times10^{-8}$ to $1\times10^{-6}$ mol, per mole of silver halide.

The iridium compounds used in the present invention include hexachloroiridium, hexabromoiridium, hexaammineiridium, pentachloronitrosyliridium and so forth.

The silver halide emulsion used for the present invention is preferably subjected to chemical sensitization. The chemical sensitization may be performed by using a known method such as sulfur sensitization, selenium sensitization, tellurium sensitization and noble metal sensitization. These sensitization methods may be used each alone or in any combination. When these sensitization methods are used in combination, preferable combinations include sulfur and gold sensitizations, sulfur, selenium and gold sensitizations, sulfur, tellurium and gold sensitizations and so forth.

The sulfur sensitization used in the present invention is usually performed by adding a sulfur sensitizer and stirring the emulsion at a high temperature of 40° C. or above for a predetermined time. The sulfur sensitizer may be a known compound, and examples thereof include, in addition to the sulfur compounds contained in gelatin, various sulfur compounds such as thiosulfates, thioureas, thiazoles and rhodanines, among which thiosulfates and thioureas compounds are preferred. As the thiourea compounds, the tetrasubstituted thiourea compounds described in U.S. Pat. No. 4,810,626 are particularly preferred. Although the amount of the sulfur sensitizer to be added varies depending on various conditions such as pH, temperature and grain size of silver halide at the time of chemical ripening, it is preferably $10^{-7}$ to $10^{-2}$ mol, more preferably $10^{-5}$ to $10^{-3}$ mol, per mol of silver halide.

The selenium sensitizer used for the present invention may be a known selenium compound. That is, the selenium sensitization is usually performed by adding a labile and/or non-labile selenium compound and stirring the emulsion at a high temperature of 40° C. or above for a predetermined time. Examples of the labile selenium compound include those described in JP-B-44-15748, JP-B-43-13489, JP-A-4-109240 and JP-A-4-324855. Among these, particularly preferred are those compounds represented by formulas (VIII) and (IX) described in JP-A-4-324855.

The tellurium sensitizer that can be used for the present invention is a compound capable of producing silver telluride, presumably serving as a sensitization nucleus, on the surface or inside of silver halide grains. The formation rate of silver telluride in a silver halide emulsion can be examined according to the method described in JP-A-5-313284.

Specifically, there can be used the compounds described in U.S. Pat. Nos. 1,623,499, 3,320,069 and 3,772,031; British Patents Nos. 235,211, 1,121,496, 1,295,462 and 1,396,696; Canadian Patent No. 800,958; JP-A-4-204640, JP-A-4-271341, JP-A-4-333043, JP-A-5-303157; J. Chem. Soc. Chem. Commun., 635 (1980); ibid., 1102 (1979); ibid., 645 (1979); J. Chem. Soc. Perkin. Trans., 1, 2191 (1980); S. Patai (compiler), The Chemistry of Organic Selenium and Tellurium Compounds, Vol. 1 (1986); and ibid., Vol. 2 (1987). The compounds represented by the formulas (II), (III) and (IV) described in JP-A-4-324855 are particularly preferred.

The amount of the selenium or tellurium sensitizer used for the present invention varies depending on silver halide grains used, chemical ripening conditions and so forth. However, it is generally about $10^{-8}$ to about $10^{-2}$ mol, preferably about $10^{-7}$ to about $10^{-3}$ mol, per mol of silver halide. The conditions for chemical sensitization in the present invention are not particularly restricted. However, in general, pH is 5–8, pAg is 6–11, preferably 7–10, and temperature is 40–95° C., preferably 45–85° C.

Noble metal sensitizers that can be used for the present invention include gold, platinum, palladium, iridium and so forth, and gold sensitization is particularly preferred. Specific examples of the gold sensitizers used for the present invention include chloroauric acid, potassium chloroaurate, potassium aurithiocyanate, gold sulfide and so forth, which can be used in an amount of about $10^{-7}$ to about $10^{-2}$ mol per mol of silver halide.

As for the silver halide emulsion used for the present invention, production or physical ripening process for the silver halide grains may be performed in the presence of a cadmium salt, sulfite, lead salt, thallium salt or the like.

In the present invention, reduction sensitization may be used. Examples of the reduction sensitizer include stannous salts, amines, formamidinesulfinic acid, silane compounds and so forth.

To the silver halide emulsion used in the present invention, a thiosulfonic acid compound may be added according to the method described in EP293917A.

In the silver halide photographic light-sensitive material of the present invention, one silver halide emulsion may be used or two or more silver halide emulsions, for example, those having different average grain sizes, different halogen compositions, those containing different amount and/or types of metal complexes, those having different crystal habits, those subjected to chemical sensitizations with different conditions or those having different sensitivities, may be used in combination. In order to obtain high contrast, it is especially preferable to coat an emulsion having higher sensitivity as it becomes closer to a support as described in JP-A-6-324426.

The photosensitive silver halide emulsion used in the present invention may be spectrally sensitized with a sensitizing dye for comparatively long wavelength, i.e., blue light, green light, red light or infrared light, depending on the purpose of the light-sensitive material. As the sensitizing dyes, cyanine dyes, merocyanine dyes, complex cyanine dyes, complex merocyanine dyes, holopolar cyanine dyes, styryl dyes, hemicyanine dyes, oxonol dyes, hemioxonol dyes and so forth may be used.

Other useful sensitizing dyes that can be used for the present invention are described in, for example, Research Disclosure, Item 17643, IV-A, page 23 (December, 1978); ibid., Item 18341X, page 437 (August, 1979) and references cited in the same.

In particular, sensitizing dyes having spectral sensitivity suitable for spectral characteristics of light sources in various scanners, image setters or photomechanical cameras can also be advantageously selected.

For example, A) for an argon laser light source, Compounds (I)-1 to (I)-8 described in JP-A-60-162247, Compounds I-1 to I-28 described in JP-A-2-48653, Compounds I-1 to I-13 described in JP-A-4-330434, compounds of Examples 1 to 14 described in U.S. Pat. No. 2,161,331, and Compounds 1 to 7 described in West Germany Patent No. 936,071; B) for a helium-neon laser light source or red laser diode light source, Compounds I-1 to I-38 described in JP-A-54-18726, Compounds I-1 to I-35 described in JP-A-6-75322, Compounds I-1 to I-34 described in JP-A-7-287338, and Compounds 2-1 to 2–14, 3-(1) to 3-(14) and 4-1 to 4–6 described in Japanese Patent No. 2822138; C) for an LED light source, Dyes 1 to 20 described in JP-B-55-39818, Compounds I-1 to I-37 described in JP-A-62-284343, Compounds I-1 to I-34 described in JP-A-7-287338, and Compounds 2-1 to 2–14, 3-(1) to 3-(14) and 4-1 to 4–6 described in Japanese Patent No. 2822138; D) for a semiconductor laser light source, Compounds I-1 to I-12 described in JP-A-59-191032, Compounds I-1 to I-22 described in JP-A-60-80841, Compounds I-1 to I-29 described in JP-A-4-335342, and Compounds I-1 to I-18 described in JP-A-59-192242; and E) for a tungsten or xenon light source of a photomechanical camera, Compounds (1) to (19) represented by the formula [I] described in JP-A-55-45015, Compounds 4-A to 4-S, Compounds 5-A to 5-Q, Compounds 6-A to 6-T described in JP-A-6-242547, and Compounds I-1 to I-97 described in JP-A-9-160185 and so forth may be advantageously selected. However, the present invention is not limited to these compounds.

These sensitizing dyes may be used individually or in combination, and a combination of sensitizing dyes is often used for the purpose of, in particular, supersensitization. In combination with a sensitizing dye, a dye which itself has no spectral sensitization effect, or a material that absorbs substantially no visible light, but exhibits supersensitization effect may be incorporated into the emulsion.

Useful sensitizing dyes, combinations of dyes that exhibit supersensitization effect, and materials that show supersensitization effect are described in, for example, Research Disclosure, Vol. 176, 17643, page 23, Item IV-J (December 1978); JP-B-49-25500, JP-B-43-4933, JP-A-59-19032, JP-A-59-192242 mentioned above and so forth.

The sensitizing dyes used for the present invention may be used in a combination of two or more of them. The sensitizing dye may be added to a silver halide emulsion by dispersing it directly in the emulsion, or by dissolving it in a sole or mixed solvent of such solvents as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide, and then adding the solution to the emulsion.

Alternatively, the sensitizing dye may be added to the emulsion by the method disclosed in U.S. Pat. No. 3,469,987, in which a dye is dissolved in a volatile organic solvent, the solution is dispersed in water or a hydrophilic colloid and the dispersion is added to the emulsion; the methods disclosed in JP-B-44-23389, JP-B-44-27555, JP-B-57-22091 and so forth, in which a dye is dissolved in an acid and the solution is added to the emulsion, or a dye is made into an aqueous solution in the presence of an acid or base and the solution is added to the emulsion; the method disclosed in, for example, U.S. Pat. Nos. 3,822,135 and 4,006,025, in which a dye is made into an aqueous solution or a colloid dispersion in the presence of a surfactant, and the solution or dispersion is added to the emulsion; the method disclosed in JP-A-53-102733 and JP-A-58-105141, in which a dye is directly dispersed in a hydrophilic colloid and the dispersion is added to the emulsion; or the method disclosed in JP-A-51-74624, in which a dye is dissolved by using a compound capable of red-shift and the solution is added to the emulsion. Ultrasonic waves may also be used for the preparation of the solution.

The sensitizing dye used for the present invention may be added to a silver halide emulsion at any step known to be useful during the preparation of emulsion. For example, the dye may be added at a step of formation of silver halide grains and/or in a period before desalting or at a step of desilverization and/or in a period after desalting and before initiation of chemical ripening, as disclosed in, for example, U.S. Pat. Nos. 2,735,766, 3,628,960, 4,183,756, 4,225,666, JP-A-58-184142, JP-A-60-196749 etc., or the dye may be added in any period or at any step before coating of the emulsion, such as immediately before or during chemical ripening, or in a period after chemical ripening but before coating, as disclosed in, for example, JP-A-58-113920. Further, a sole kind of compound alone or compounds different in structure in combination may be added as divided portions, for example, a part is added during grain formation, and the remaining during chemical ripening or after completion of the chemical ripening, or a part is added before or during chemical ripening and the remaining after completion of the chemical ripening, as disclosed in, for example, U.S. Pat. No. 4,225,666 and JP-A-58-7629. The kinds of compounds or the kinds of the combinations of compounds added as divided portions may be changed.

The addition amount of the sensitizing dye used for the present invention varies depending on the shape, size, halogen composition of silver halide grains, method and degree of chemical sensitization, kind of antifoggant and so forth, but the addition amount may be $4\times10^{-6}$ to $8\times10^{-3}$ mol per mol of silver halide. For example, when the silver halide grain size is from 0.2–1.3 $\mu$m, the addition amount is preferably from $2\times10^{-3}$ to $3.5\times10^{-6}$, more preferably from $6.5\times10^{-7}$ to $2.0\times10^{-6}$ mol, per $m^2$ of the surface area of silver halide grains.

The silver halide photographic light-sensitive material of the present invention may contain a nucleation accelerator.

Examples of the nucleation accelerator used in the present invention include amine derivatives, onium salts, disulfide derivatives, hydroxymethyl derivatives and so forth. Specific examples thereof include the compounds represented by the formula (1), (2), (3) or (4) described in JP-A-2001-343725, specifically, Compounds A-1 to A-42, B-1 to B-41 and C-1 to C-14 described in the same; compounds described in JP-A-7-77783, page 48, lines 2 to 37, specifically, Compounds A-1) to A-73) described on pages 49 to 58 of the same; compounds represented by (Chemical formula 21), (Chemical formula 22) and (Chemical formula 23) described in JP-A-7-84331, specifically, compounds described on pages 6 to 8 of the same; compounds represented by formulas [Na] and [Nb] described in JP-A-7-104426, specifically, Compounds Na-1 to Na-22 and Compounds Nb-1 to Nb-12 described on pages 16 to 20 of the same; compounds represented by the formulas (1), (2), (3), (4), (5), (6) and (7) described in JP-A-8-272023, specifically, Compounds 1–1 to 1–19, Compounds 2–1 to 2–22, Compounds 3–1 to 3–36, Compounds 4–1 to 4–5, Compounds 5–1 to 5–41, Compounds 6–1 to 6–58 and Compounds 7–1 to 7–38 mentioned in the same; and nucleation accelerators described in JP-A-9-297377, p.55, column 108, line 8 to p.69, column 136, line 44.

The nucleation accelerator that can be used in the present invention may be dissolved in an appropriate water-miscible organic solvent such as an alcohol (e.g., methanol, ethanol, propanol or a fluorinated alcohol), ketone (e.g., acetone or methyl ethyl ketone), dimethylformamide, dimethylsulfoxide or methyl cellosolve and used.

Alternatively, the nucleation accelerator may also be dissolved in an oil such as dibutyl phthalate, tricresyl phosphate, glyceryl triacetate or diethyl phthalate using an auxiliary solvent such as ethyl acetate or cyclohexanone and mechanically processed into an emulsion dispersion by a conventionally well-known emulsion dispersion method before use. Alternatively, powder of the nucleation accelerator may be dispersed in water by means of ball mill, colloid mill or ultrasonic waves according to a method known as solid dispersion method and used.

The nucleation accelerator that can be used in the present invention is preferably added to a non-photosensitive layer consisting of a hydrophilic colloid layer not containing silver halide emulsion provided on the silver halide emulsion layer side of the support, particularly preferably to a non-photosensitive layer consisting of a hydrophilic colloid layer between a silver halide emulsion layer and the support.

The nucleation accelerator is preferably used in an amount of $1\times10^{-6}$ to $2\times10^{-2}$ mol, more preferably $1\times10^{-5}$ to $2\times10^{-2}$ mol, most preferably $2\times10^{-5}$ to $1\times10^{-2}$ mol, per mol of silver halide. It is also possible to use two or more kinds of nucleation accelerators in combination.

There are no particular limitations on various additives used in the silver halide photographic light-sensitive material of the present invention and, for example, those described below can be used: polyhydroxybenzene compounds described in JP-A-3-39948, page 10, right lower column, line 11 to page 12, left lower column, line 5, specifically, Compounds (III)-1 to (III)-25 described in the same; compounds that substantially do not have an absorption maximum in the visible region represented by the formula (I) described in JP-A-1-118832, specifically, Compounds I-1 to I-26 described in the same; antifoggants described in JP-A-2-103536, page 17, right lower column, line 19 to page 18, right upper column, line 4; polymer latexes described in JP-A-2-103536, page 18, left lower column, line 12 to left lower column, line 20, polymer latexes having an active methylene group represented by formula (I) described in JP-A-9-179228, specifically, Compounds I-1 to I-16 described in the same, polymer latexes having core/shell structure described in JP-A-9-179228, specifically, Compounds P-1 to P-55 described in the same, and acidic polymer latexes described in JP-A-7-104413, page 14, left column, line 1 to right column, line 30, specifically, Compounds II-1) to II-9) described on page 15 of the same; matting agents, lubricants and plasticizers described in JP-A-2-103536, page 19, left upper column, line 15 to right upper column, line 15; hardening agents described in JP-A-2-103536, page 18, right upper column, line 5 to line 17; compounds having an acid radical described in JP-A-2-103536, page 18, right lower column, line 6 to page 19, left upper column, line 1; conductive materials described in JP-A-2-18542, page 2, left lower column, line 13 to page 3, right upper column, line 7, specifically, metal oxides described in page 2, right lower column, line 2 to line 10 of the same, and conductive polymer compounds P-1 to P-7 described in the same; water-soluble dyes described in JP-A-2-103536, page 17; solid dispersion dyes represented by the formulas (FA), (FA1), (FA2) and (FA3) described in JP-A-9-179243, specifically, Compounds F1 to F34 described in the same; Compounds (II-2) to (II-24), Compounds (III-5) to (III-18) and Compounds (IV-2) to (IV-7) described in JP-A-7-152112, and solid dispersion dyes described in JP-A-2-294638 and JP-A-5-11382; redox compounds capable of releasing a development inhibitor by oxidation described in JP-A-5-274816, preferably redox compounds represented by the formulas (R-1), (R-2) and (R-3) described in the same, specifically, Compounds R-1 to R-68 described in the same; and binders described in JP-A-2-18542, page 3, right lower column, line 1 to line 20.

The swelling ratio of the hydrophilic colloid layers including the emulsion layers-and protective layers of the silver halide photographic light-sensitive material of the present invention is preferably in the range of 80–150%, more preferably 90–140%. The swelling ratio of the hydrophilic colloid layer can be determined in the following manner. The thickness ($d_0$) of the hydrophilic colloid layers including the emulsion layers and protective layers of the silver halide photographic light-sensitive material is measured and the swollen thickness ($\Delta d$) is measured after the silver halide photographic material is immersed in distilled water at 25° C. for one minute. Then, the swelling ratio is calculated from the following equation: Swelling ratio (%)= $(\Delta d/d_0)\times100$.

The silver halide photographic light-sensitive material of the present invention preferably has a film surface pH of 6.0 or lower, more preferably 4.5–7.5, further preferably 4.8–6.0, for the side on which silver halide emulsion layer is coated. If it is less than 4.5, hardening of the emulsion layer tends to be delayed.

As supports that can be used for practicing the present invention, for example, baryta paper, polyethylene-laminated paper, polypropylene synthetic paper, glass plate, cellulose acetate, cellulose nitrate, and polyester film such as polyethylene terephthalate film can be exemplified. The support is appropriately selected depending on the intended use of the silver halide photographic light-sensitive material.

Further, supports comprising a styrene polymer having syndiotactic structure described in JP-A-7-234478 and U.S. Pat. No. 5,558,979 are also preferably used.

Processing chemicals such as developing solution (developer) and fixing solution (fixer) and processing methods that can be used for the silver halide photographic light-sensitive material according to the present invention are described below, but of course the present invention should not be construed as being limited to the following description and specific examples.

For the development of the silver halide photographic light-sensitive material of the present invention, any of known methods can be used, and known developers can be used.

A developing agent for use in developer (hereinafter, starter developer and replenisher developer are collectively referred to as developer) used for the present invention is not particularly limited, but the developer preferably contains a dihydroxybenzene compound, ascorbic acid derivative or hydroquinonemonosulfonate, and they can be used each alone or in combination. In particular, a dihydroxybenzene type developing agent and an auxiliary developing agent exhibiting superadditivity are preferably contained in combination, and combinations of a dihydroxybenzene compound or an ascorbic acid derivative with a 1-phenyl-3-pyrazolidone compound, or combinations of a dihydroxybenzene compound or ascorbic acid derivative with a p-aminophenol compound can be mentioned.

Examples of the dihydroxybenzene developing agent as a developing agent used for the present invention includes hydroquinone, chlorohydroquinone, isopropylhydroquinone, methylhydroquinone and so forth, and hydroquinone is particularly preferred. Examples of the ascorbic acid derivative developing agent include ascorbic acid, isoascorbic acid and salts thereof. Sodium erythorbate is particularly preferred in view of material cost.

Examples of the 1-phenyl-3-pyrazolidones or derivatives thereof as the developing agent used for the present invention include 1-phenyl-3-pyrazolidone, 1-phenyl-4,4-dimethyl-3-pyrazolidone, 1-phenyl-4-methyl-4-hydroxymethyl-3-pyrazolidone and so forth.

Examples of the p-aminophenol type developing agent that can be used for the present invention include N-methyl-p-aminophenol, p-aminophenol, N-(β-hydroxyphenyl)-p-aminophenol, N-(4-hydroxyphenyl)glycine, o-methoxy-p-(N,N-dimethylamino)phenol, o-methoxy-p-(N-methylamino)phenol etc., and N-methyl-p-aminophenol and aminophenols described in JP-A-9-297377 and JP-A-9-297378 are preferred.

The dihydroxybenzene type developing agent is preferably used in an amount of generally 0.05–0.8 mol/L. When a dihydroxybenzene compound and a 1-phenyl-3-pyrazolidone compound or a p-aminophenol compound are used in combination, the former is preferably used in an amount of 0.05–0.6 mol/L, more preferably 010–0.5 mol/L, and the latter is preferably used in an amount of 0.06 mol/L or less, more preferably 0.003–0.03 mol/L.

The ascorbic acid derivative developing agent is preferably used in an amount of generally 0.01–0.5 mol/L, more preferably 0.05–0.3 mol/L. When an ascorbic acid derivative and a 1-phenyl-3-pyrazolidone compound or a p-aminophenol compound are used in combination, the ascorbic acid derivative is preferably used in an amount of from 0.01–0.5 mol/L, and the 1-phenyl-3-pyrazolidone compound or p-aminophenol compound is preferably used in an amount of 0.005–0.2 mol/L.

The developer used in processing the silver halide photographic light-sensitive material of the present invention may contain additives (e.g., a developing agent, alkali agent, pH buffer, preservative, chelating agent etc.) that are commonly used. Specific examples thereof are described below, but the present invention is by no means limited to them.

Examples of the buffer for use in the developer used in development include carbonates, boric acids described in JP-A-62-186259, saccharides (e.g., saccharose) described in JP-A-60-93433, oximes (e.g., acetoxime), phenols (e.g., 5-sulfosalicylic acid) tertiary phosphates (e.g., sodium salt and potassium salt) etc., and carbonates are preferably used. The amount of the buffer, in particular, the carbonates, is preferably 0.05 mol/L or more, particularly preferably 0.08–1.0 mol/L.

In the present invention, both the starter developer and the replenisher developer preferably have a property that the solution shows pH increase of 0.8 or less when 0.1 mol of sodium hydroxide is added to 1 L of the solution. As for the method of confirming whether the starter developer or replenisher developer used has the property, pH of the starter developer or replenisher developer to be tested is adjusted to 10.5, 0.1 mol of sodium hydroxide is added to 1 L of the solution, then pH of the solution is measured, and if increase of pH value is in the range of 0.8 or less, the solution is determined to have the property defined above. In the present invention, it is particularly preferable to use a starter developer and replenisher developer showing pH increase of 0.7 or less in the aforementioned test.

Examples of the preservative that can be used for the present invention include sodium sulfite, potassium sulfite, lithium sulfite, ammonium sulfite, sodium bisulfite, sodium methabisulfite, formaldehyde-sodium bisulfite and so forth. A sulfite is used in an amount of preferably 0.2 mol/L or more, particularly preferably 0.3 mol/L or more, but if it is added in an unduly large amount, silver staining in the developer is caused. Accordingly, the upper limit is preferably 1.2 mol/L. The amount is particularly preferably 0.35–0.7 mol/L.

As the preservative for a dihydroxybenzene type developing agent, a small amount of the aforementioned ascorbic acid derivative may be used together with the sulfite. Sodium erythorbate is particularly preferably used in view of material cost. It is preferably added in an amount of 0.03–0.12, particularly preferably 0.05–0.10, in terms of molar ratio with respect to the dihydroxybenzene type developing agent. When an ascorbic acid derivative is used as the preservative, the developer preferably does not contain a boron compound.

Examples of additives to be used other than those described above include a development inhibitor such as sodium bromide and potassium bromide, an organic solvent such as ethylene glycol, diethylene glycol, triethylene glycol and dimethylformamide, a development accelerator such as an alkanolamine including diethanolamine, triethanolamine etc. and an imidazole and derivatives thereof, and an agent for preventing uneven physical development such as a heterocyclic mercapto compound (e.g., sodium 3-(5-mercaptotetrazol-1-yl)-benzenesulfonate, 1-phenyl-5-mercaptotetrazole etc.) and the compounds described in JP-A-62-212651.

Further, a mercapto compound, indazole compound, benzotriazole compound or benzimidazole compound may be added as an antifoggant or a black spot (black pepper) inhibitor. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-((2-mercapto-1,3,4-thiadiazol-2-yl)thio)butanesulfonate, 5-amino-1,3,4-thiadiazole-2-thiol, methylbenzotriazole, 5-methylbenzotriazole, 2-mercaptobenzotriazole and so forth. The addition amount thereof is generally 0.01–10 mol, preferably 0.1–2 mmol, per liter of the developer.

Further, various kinds of organic or inorganic chelating agents can be used individually or in combination in the developer used for the present invention.

As the inorganic chelating agents, sodium tetrapolyphosphate, sodium hexametaphosphate and so forth can be used.

As the organic chelating agents, organic carboxylic acid, aminopolycarboxylic acid, organic phosphonic acid, aminophosphonic acid and organic phosphonocarboxylic acid can be mainly used.

Examples of the organic carboxylic acid include acrylic acid, oxalic acid, malonic acid, succinic acid, glutaric acid, gluconic acid, adipic acid, pimelic acid, azelaic acid, sebacic acid, nonanedicarboxylic acid, decanedicarboxylic acid, undecanedicarboxylic acid, maleic acid, itaconic acid, malic acid, citric acid, tartaric acid etc.

Examples of the aminopolycarboxylic acid include iminodiacetic acid, nitrilotriacetic acid, nitrilotripropionic acid, ethylenediaminemonohydroxyethyltriacetic acid, ethylenediaminetetraacetic acid, glycol ether-tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether-diaminetetraacetic acid, and compounds described in JP-A-52-25632, JP-A-55-67747, JP-A-57-102624 and JP-B-53-40900.

Examples of the organic phosphonic acid include hydroxyalkylidene-diphosphonic acids described in U.S. Pat. Nos. 3,214,454 and 3,794,591 and West German Patent Publication No. 2,227,369, and the compounds described in Research Disclosure, Vol. 181, Item 18170 (May, 1979) and so forth.

Examples of the aminophosphonic acid include aminotris(methylenephosphonic acid), ethylenediaminetetramethylenephosphonic acid, aminotrimethylenephosphonic acid and so forth, and the compounds described in Research Disclosure, No. 18170 (supra), JP-A-57-208554, JP-A-54-61125, JP-A-55-29883, JP-A-56-97347 and so forth can also be mentioned.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956, Research Disclosure, No. 18170 (supra) and so forth.

The organic and/or inorganic chelating agents are not limited to those described above. The organic and/or inorganic chelating agents may be used in the form of an alkali metal salt or an ammonium salt. The amount of the chelating agent added is preferably $1\times10^{-4}$ to $1\times10^{-1}$ mol, more preferably $1\times10^{-3}$ to $1\times10^{-2}$ mol, per liter of the developer.

Further, a silver stain inhibitor may be added to the developer, and examples thereof include, for example, the compounds described in JP-A-56-24347, JP-B-56-46585, JP-B-62-2849, JP-A-4-362942 and JP-A-8-6215; triazines having one or more mercapto groups (for example, the compounds described in JP-B-6-23830, JP-A-3-282457 and JP-A-7-175178); pyrimidines having one or more mercapto groups (e.g., 2-mercaptopyrimidine, 2,6-dimercaptopyrimidine, 2,4-dimercaptopyrimidine, 5,6-diamino-2,4-dimercaptopyrimidine, 2,4,6-trimercaptopyrimidine, the compounds described in JP-A-9-274289 etc.); pyridines having one or more mercapto groups (e.g., 2-mercaptopyridine, 2,6-dimercaptopyridine, 3,5-dimercaptopyridine, 2,4,6-trimercaptopyridine, compounds described in JP-A-7-248587 etc.); pyrazines having one or more mercapto groups (e.g., 2-mercaptopyrazine, 2,6-dimercaptopyrazine, 2,3-dimercaptopyrazine, 2,3,5-trimercaptopyrazine etc.); pyridazines having one or more mercapto groups (e.g., 3-mercaptopyridazine, 3,4-dimercaptopyridazine, 3,5-dimercaptopyridazine, 3,4,6-trimercaptopyridazine etc.); the compounds described in JP-A-7-175177, polyoxyalkylphosphates described in U.S. Pat. No. 5,457,011 and so forth. These silver stain inhibitors may be used individually or in combination of two or more of these. The addition amount thereof is preferably 0.05–10 mmol, more preferably 0.1–5 mmol, per liter of the developer.

The developer may also contain the compounds described in JP-A-61-267759 as a dissolution aid.

Further, the developer may also contain a toning agent, surfactant, defoaming agent, hardening agent or the like, if necessary.

The developer preferably has a pH of 9.0–12.0, more preferably 9.0–11.0, particularly preferably 9.5–11.0. The alkali agent used for adjusting pH may be a usual water-soluble inorganic alkali metal salt (e.g., sodium hydroxide, potassium hydroxide, sodium carbonate, potassium carbonate etc.).

As for the cation of the developer, potassium ion less inhibits development and causes less indentations, called fringes, on peripheries of blackened portions, compared with sodium ion. Further, when the developer is stored as a concentrated solution, potassium salt is generally preferred, because of its higher solubility. However, since, in the fixer, potassium ion causes fixing inhibition on the same level as silver ion, a high potassium ion concentration in the developer disadvantageously causes increase of the potassium ion concentration in the fixer because of carrying over of the developer by the silver halide photographic light-sensitive material. In view of the above, the molar ratio of potassium ion to sodium ion in the developer is preferably between 20:80 and 80:20. The ratio of potassium ion to sodium ion can be freely controlled within the above-described range by a counter cation such as those derived from a pH buffer, pH adjusting agent, preservative, chelating agent or the like.

The replenishing amount of the developer is generally 470 mL or less, preferably 30–325 mL, per $m^2$ of the silver halide photographic light-sensitive material. The replenisher developer may have the same composition and/or concentration as the starter developer, or it may have a different composition and/or concentration from those of the starter developer.

Examples of the fixing agent in the fixing processing agent that can be used for the present invention include ammonium thiosulfate, sodium thiosulfate and ammonium sodium thiosulfate. The amount of the fixing agent may be varied appropriately, but it is generally about 0.7–3.0 mol/L.

The fixer that can be used for the present invention may contain a water-soluble aluminum salt or a water-soluble chromium salt, which acts as a hardening agent, and of these salts, a water-soluble aluminum salt is preferred. Examples thereof include aluminum chloride, aluminum sulfate, potassium alum, ammonium aluminum sulfate, aluminum nitrate, aluminum lactate and so forth. These are preferably contained in an amount of 0.01–0.15 mol/L in terms of aluminum ion concentration in the solution used.

When the fixer is stored as a concentrated solution or a solid agent, it may be constituted by a plurality of parts including a hardening agent or the like as a separate part, or it may be constituted as a one-part agent containing all components.

The fixing processing agent may contain, if desired, a preservative (e.g., sulfite, bisulfite, metabisulfite etc. in an amount of 0.015 mol/L or more, preferably 0.02–0.3 mol/L), pH buffer (e.g., acetic acid, sodium acetate, sodium carbonate, sodium hydrogencarbonate, phosphoric acid, succinic acid, adipic acid etc. in an amount of generally 0.1–1 mol/L, preferably 0.2–0.7 mol/L), and a compound having aluminum-stabilizing ability or hard water-softening ability (e.g., gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, cysteine, ethylenediaminetetraacetic acid, nitrilotriacetic acid, derivatives and salts thereof, saccharides etc. in an amount of 0.001–0.5 mol/L, preferably 0.005–0.3 mol/L). However, in view of environmental protection recently concerned, it is preferred that a boron compound is not contained.

In addition, the fixing processing agent may contain the compounds described in JP-A-62-78551, pH adjusting agent (e.g., sodium hydroxide, ammonia, sulfuric acid etc.), surfactant, wetting agent, fixing accelerator etc. Examples of the surfactant include anionic surfactants such as sulfated products and sulfonated products, polyethylene surfactants and amphoteric surfactants described in JP-A-57-6840. Known deforming agents may also be used. Examples of the wetting agent include alkanolamines and alkylene glycols. Examples of the fixing accelerator include alkyl- or aryl-substituted thiosulfonic acids and salts thereof described in JP-A-6-308681; thiourea derivatives described in JP-B-45-35754, JP-B-58-122535 and JP-B-58-122536; alcohols having a triple bond within the molecule; thioether compounds described in U.S. Pat. No. 4,126,459; mercapto compounds described in JP-A-64-4739, JP-A-1-4739, JP-A-1-159645 and JP-A-3-101728; mesoionic compounds and thiocyanates described in JP-A-4-170539.

pH of the fixer used for the present invention is preferably 4.0 or more, more preferably 4.5–6.0. pH of the fixer rises with processing by the contamination of developer. In such a case, pH of a hardening fixer is preferably 6.0 or less, more preferably 5.7 or less, and that of a non-hardening fixer is preferably 7.0 or less, more preferably 6.7 or less.

The replenishing rate of the fixer is preferably 500 mL or less, more preferably 390 mL or less, still more preferably 80–325 mL, per $m^2$ of the silver halide photographic light-sensitive material. The composition and/or the concentration of the replenisher fixer may be the same as or different from those of the starter fixer.

The fixer can be reclaimed for reuse according to known fixer reclaiming methods such as electrolytic silver recovery. As reclaiming apparatuses, there are FS-2000 produced by Fuji Photo Film Co., Ltd. and so forth.

Further, removal of dyes and so forth using an adsorptive filter such as those comprising activated carbon is also preferred.

When the developing and fixing processing chemicals used in the present invention are solutions, they are preferably preserved in packaging materials of low oxygen permeation as disclosed in JP-A-61-73147. Further, when these solutions are concentrated solutions, they are diluted with water to a predetermined concentration in the ratio of 0.2–3 parts of water to one part of the concentrated solutions.

Even if the developing processing chemicals and fixing processing chemicals used in the present invention are made as solids, the same effects as solutions can be obtained. Solid processing chemicals are described below.

Solid chemicals that can be used for the present invention may be made into known shapes such as powders, granular powders, granules, lumps, tablets, compactors, briquettes, plates, bars, paste or the like. These solid chemicals may be covered with water-soluble coating agents or films to separate components that react with each other on contact, or they may have a multilayer structure to separate components that react with each other, or both types may be used in combination.

Although known coating agents and auxiliary granulating agents can be used, polyvinylpyrrolidone, polyethylene glycol, polystyrenesulfonic acid and vinyl compounds are preferably used. Further, JP-A-545805, column 2, line 48 to column 3, line 13 can be referred to.

When a multilayer structure is used, components that do not react with each other on contact may be sandwiched with components that react with each other and made into tablets or briquettes, or components of known shapes may be made into a similar layer structure and packaged. Methods therefor are disclosed in JP-A-61-259921, JP-A-4-16841, JP-A-4-78848, JP-A-5-93991 and so forth.

The bulk density of the solid processing chemicals is preferably 0.5–6.0 g/$cm^3$, in particular, the bulk density of tablets is preferably 1.0–5.0 g/$cm^3$, and that of granules is preferably 0.5–1.5 g/$cm^3$.

Solid processing chemicals used for the present invention can be produced by using any known method, and one can refer to, for example, JP-A-61-259921, JP-A-4-15641, JP-A-4-16841, JP-A-4-32837, JP-A-4-78848, JP-A-5-93991, JP-A-4-85533, JP-A-4-85534, JP-A-4-85535, JP-A-5-134362, JP-A-5-197070, JP-A-5-204098, JP-A-5-224361, JP-A-6-138604, JP-A-6-138605, JP-A-8-286329 and so forth.

More specifically, the rolling granulating method, extrusion granulating method, compression granulating method, cracking granulating method, stirring granulating method, spray drying method, dissolution coagulation method, briquetting method, roller compacting method and so forth can be used.

The solubility of the solid chemicals used in the present invention can be adjusted by changing state of surface (smooth, porous, etc.) or partially changing the thickness, or making the shape into a hollow doughnut type. Further, it is also possible to provide different solubilities to a plurality of granulated products, or it is also possible for materials having different solubilities to use various shapes to obtain the same solubilities. Multilayer granulated products having different compositions between the inside and the surface can also be used.

Packaging materials of solid chemicals preferably have low oxygen and water permeabilities, and those of known shapes such as bag-like, cylindrical and box-like shapes can be used. Packaging materials of foldable shapes are preferred for saving storage space of waste packaging materials as disclosed in JP-A-6-242585 to JP-A-6-242588, JP-A-6-247432, JP-A-6-247448, JP-A-6-301189, JP-A-7-5664, and JP-A-7-5666 to JP-A-7-5669. Takeout ports of processing chemicals of these packaging materials may be provided with a screw cap, pull-top or aluminum seal, or packaging materials may be heat-sealed, or other known types may be used, and there are no particular limitations. Waste packaging materials are preferably recycled or reused in view of environmental protection.

Methods of dissolution and replenishment of the solid processing chemicals are not particularly limited, and known methods can be used. Examples of these known methods include a method in which a certain amount of processing chemicals are dissolved and replenished by a dissolving apparatus having a stirring function, a method in which processing chemicals are dissolved by a dissolving apparatus having a dissolving zone and a zone where a finished solution is stocked and the solution is replenished from the stock zone as disclosed in JP-A-9-80718, and methods in which processing chemicals are fed to a circulating system of an automatic processor and dissolved and replenished, or processing chemicals are fed to a dissolving tank provided in an automatic processor with progress of the processing of silver halide photographic light-sensitive materials as disclosed in JP-A-5-119454, JP-A-6-19102 and JP-A-7-261357. In addition to the above methods, any of known methods can be used. The charge of processing chemicals may be conducted manually, or automatic opening and automatic charge may be conducted by using a dissolving apparatus or automatic processor provided with an opening mechanism as disclosed in JP-A-9-138495. The latter is preferred in view of the working environment. Specifically, there are methods of pushing through, unsealing, cutting off and bursting a takeout port of package, methods disclosed in JP-A-6-19102 and JP-A-6-95331 and so forth.

A silver halide photographic light-sensitive material is subjected to washing or stabilizing processing after being developed and fixed (hereinafter washing includes stabilization processing, and a solution used therefor is called water or washing water unless otherwise indicated). The water used for washing may be any of tap water, ion exchange water, distilled water and stabilized solution. The replenishing rate therefor is, in general, about 8–17 liters per $m^2$ of the silver halide photographic light-sensitive material, but washing can be carried out with a replenishing rate less than the above. In particular, with a replenishing rate of 3 liters or less (including zero, i.e., washing in a reservoir), not only water saving processing can be carried out but also piping for installation of an automatic processor becomes unnecessary. When washing is carried out with a reduced replenishing amount of water, it is more preferable to use a washing tank equipped with a squeegee roller or a crossover roller disclosed in JP-A-63-18350, JP-A-62-287252 or the like. The addition of various kinds of oxidizing agents (e.g., ozone, hydrogen peroxide, sodium hypochlorite, activated halogen, chlorine dioxide, sodium carbonate hydrogen peroxide salt etc.) and filtration through filters may be combined to reduce load on environmental pollution, which becomes a problem when washing is carried out with a small amount of water, and to prevent generation of scale.

As a method of reducing the replenishing amount of the washing water, a multistage countercurrent system (e.g., two stages or three stages) has been known for a long time. The replenishing amount of the washing water in this system is preferably 50–200 mL per $m^2$ of the silver halide photographic light-sensitive material. This effect can also similarly be obtained in an independent multistage system (a method in which a countercurrent is not used and fresh solution is separately replenished to multistage washing tanks).

Further, means for preventing generation of scale may be included in a washing process. Means for preventing generation of scale is not particularly limited, and known methods can be used. There are, for example, a method of adding an antifungal agent (so-called scale preventive), a method of using electroconduction, a method of irradiating ultraviolet ray, infrared ray or far infrared ray, a method of applying a magnetic field, a method of using ultrasonic wave processing, a method of applying heat, a method of emptying tanks when they are not used and so forth. These scale preventing means may be used with progress of the processing of silver halide photographic light-sensitive materials, may be used at regular intervals irrespective of usage conditions, or may be conducted only during the time when processing is not conducted, for example, during night. In addition, washing water previously subjected to a treatment with such means may be replenished. It is also preferable to use different scale preventing means for every given period of time for inhibiting proliferation of resistant fungi.

As a water-saving and scale-preventing apparatus, an apparatus AC-1000 produced by Fuji Photo Film Co., Ltd. and a scale-preventing agent AB-5 produced by Fuji Photo Film Co., Ltd. may be used, and the method disclosed in JP-A-11-231485 may also be used.

The antifungal agent is not particularly restricted, and a known antifungal agent may be used. Examples thereof include, in addition to the above-described oxidizing agents, glutaraldehyde, chelating agent such as aminopolycarboxylic acid, cationic surfactant, mercaptopyridine oxide (e.g., 2-mercaptopyridine-N-oxide) and so forth, and a sole antifungal agent may be used, or a plurality of antifungal agents may be used in combination.

The electricity may be applied according to the methods described in JP-A-3-224685, JP-A-3-224687, JP-A-4-16280, JP-A-4-18980 and so forth.

In addition, a known water-soluble surfactant or defoaming agent may be added so as to prevent uneven processing due to bubbling, or to prevent transfer of stains. Further, the dye adsorbent described in JP-A-63-163456 may be provided in the washing with water system, so as to prevent stains due to a dye dissolved out from the silver halide photographic light-sensitive material.

Overflow solution from the washing with water step may be partly or wholly used by mixing it with the processing solution having fixing ability, as described in JP-A-60-235133. It is also preferable, in view of protection of the natural environment, to reduce the biochemical oxygen demand (BOD), chemical oxygen demand (COD), iodine consumption or the like in waste water before discharge by subjecting the solution to microbial treatment (for example, activated sludge treatment, treatment with a filter comprising a porous carrier such as activated carbon or ceramic carrying microorganisms such as sulfur-oxidizing bacteria etc.), electrification or oxidation treatment with an oxidizing agent before discharge, or to reduce the silver concentration in waste water by passing the solution through a filter using a polymer having affinity for silver, or by adding a compound that forms a hardly soluble silver complex, such as trimercaptotriazine, to precipitate silver, and then passing the solution through a filter.

In some cases, stabilization may be performed subsequent to the washing with water, and as an example thereof, a bath containing the compounds described in JP-A-2-201357, JP-A-2-132435, JP-A-1-102553 and JP-A-46-44446 may be used as a final bath of the silver halide photographic light-sensitive material. This stabilization bath may also contain, if desired, an ammonium compound, metal compound such as Bi or Al, fluorescent brightening agent, various chelating agents, layer pH-adjusting agent, hardening agent, bactericide, antifungal agent, alkanolamine or surfactant.

The additives such as antifungal agent and the stabilizing agent added to the washing with water or stabilization bath may be formed into a solid agent like the aforementioned development and fixing processing agents.

Waste solutions of the developer, fixer, washing water or stabilizing solution used for the present invention are preferably burned for disposal. The waste solutions can also be concentrated or solidified by a concentrating apparatus such as those described in JP-8-7-83867 and U.S. Pat. No. 5,439,560, and then disposed.

When the replenishing amount of the processing agents is reduced, it is preferable to prevent evaporation or air oxidation of the solution by reducing the opening area of the processing tank. A roller transportation-type automatic developing machine is described in, for example, U.S. Pat. Nos. 3,025,779 and 3,545,971, and in the present specification, it is simply referred to as a roller transportation-type automatic processor. This automatic processor performs four steps of development, fixing, washing with water and drying, and it is most preferable to follow this four-step processing also in the present invention, although other steps (e.g., stopping step) are not excluded. Further, a rinsing bath, tank for washing with water or washing tank may be provided between development and fixing and/or between fixing and washing with water.

In the development of the silver halide photographic light-sensitive material of the present invention, the dry-to-dry time from the start of processing to finish of drying is preferably 25–160 seconds, the development time and the fixing time are each generally 40 seconds or less, preferably 6–35 seconds, and the temperature of each solution is preferably 25–50° C., more preferably 30–40° C. The temperature and the time of washing with water are preferably 0–50° C. and 40 seconds or less, respectively. In the present invention, the silver halide photographic light-sensitive material after development, fixing and washing with water may be passed between squeeze rollers for squeezing washing water, and then dried. The drying is generally performed at a temperature of from about 40° C. to about 100° C. The drying time may be appropriately varied depending on the ambient conditions. The drying method is not particularly limited, and any known method may be used. Hot-air drying and drying by a heat roller or far infrared rays as described in JP-A-4-15534, JP-A-5-2256 and JP-A-5-289294 may be used, and a plurality of drying methods may also be used in combination.

The present invention will be specifically explained with reference to the following examples and comparative examples. The materials, amounts, ratios, types and procedures of processes and so forth shown in the following examples can be optionally changed so long as such change does not depart from the spirit of the present invention. Therefore, the scope of the present invention should not be construed in any limitative way based on the following examples.

EXAMPLE 1

In this example, silver halide photographic light-sensitive materials satisfying the requirements of the present invention and comparative silver halide photographic light-sensitive materials were prepared and evaluated. Production methods of emulsions and non-photosensitive silver halide grains used for the production of those silver halide photographic light-sensitive materials will be explained first, and then the method for producing the silver halide photographic light-sensitive materials and evaluations of them will be described.

Preparation of Emulsion A

| Solution 1 | |
|---|---|
| Water | 750 mL |
| Gelatin | 20 g |
| Sodium chloride | 3 g |
| 1,3-Dimethylimidazolidine-2-thione | 20 mg |
| Sodium benzenethiosulfonate | 10 mg |
| Citric acid | 0.7 g |

-continued

| Solution 2 | |
|---|---|
| Water | 300 mL |
| Silver nitrate | 150 g |
| Solution 3 | |
| Water | 290 mL |
| Sodium chloride | 38 g |
| Potassium bromide | 32 g |
| $(NH_4)_3[RhCl_5(H_2O)]$ | $2.5 \times 10^{-7}$ mol/totaL Ag mol (10.7 mL of 0.001% solution in 20% NaCl aqueous solution) |

$(NH_4)_3[RhCl_5(H_2O)]$ (0.001% solution) used for Solution 3 was prepared by dissolving its powder in 20% aqueous solution of NaCl and heating the solution at 40° C. for 120 minutes.

Solution 2 and Solution 3 in amounts corresponding to 90% of each were simultaneously added to Solution 1 maintained at 38° C. and pH 4.5 over 20 minutes with stirring to form nucleus grains having a diameter of 0.19 $\mu$m. Subsequently, Solution 4 and Solution 5 shown below were added over 8 minutes. Further, the remaining 10% of Solution 2 and Solution 3 were added over 2 minutes to allow growth of the grains to a diameter of 0.21 $\mu$m. Further, 0.15 g of potassium iodide was added and ripening was allowed for 5 minutes to complete the grain formation.

| Solution 4 | |
|---|---|
| Water | 100 mL |
| Silver nitrate | 50 g |
| Solution 5 | |
| Water | 80 mL |
| Sodium chloride | 13 g |
| Potassium bromide | 11 g |
| $K_4[Fe(CN)_6].3H_2O$ | $4 \times 10^{-5}$mol/total Ag mol (19 mL as 0.1% aqueous solution) |

Then, the resulting grains were washed according to a conventional flocculation method. Specifically, after the temperature of the mixture was lowered to 35° C., 3 g of Anionic precipitating agent 1 shown below was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In a volume of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.6 and pAg to 7.5, added with 10 mg of sodium benzenethiosulfonate, 3 mg of sodium benzenethiosulfinate, 15 mg of sodium thiosulfate pentahydrate and 4 mg of chloroauric acid to perform chemical sensitization at 55° C. for obtaining optimal sensitivity, and then added with 100 mg of 4-hydroxy-6-methyl-1,3,3a,7-tetrazaindene as a stabilizer and 100 mg of an antiseptic (Proxcel, ICI Co., Ltd.).

Finally, there was obtained an emulsion of cubic silver iodochlorobromide grains containing 30 mol % of silver bromide and 0.08 mol % of silver iodide and having an average grain size of 0.21 μm with a variation coefficient of 9%. The emulsion finally showed pH of 5.7, pAg of 7–5, electric conductivity of 40 μS/m, density of 1.2–1.25×$10^3$ kg/$m^3$ and viscosity of 50 mPa·s.

Anionic Precipitating Agent 1

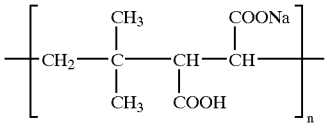

Average molecular weight: 120,000

Preparation of Non-photosensitive Silver Halide Grains

| Solution 1 | |
|---|---|
| Water | 1 L |
| Gelatin | 20 g |
| Sodium chloride | 3.0 g |
| 1,3-Dimethylimidazolidine-2-thione | 20 mg |
| Sodium benzenethiosulfonate | 8 mg |
| **Solution 2** | |
| Water | 400 mL |
| Silver nitrate | 100 g |
| **Solution 3** | |
| Water | 400 mL |
| Sodium chloride | 13.5 g |
| Potassium bromide | 45.0 g |
| $(NH_4)_3$ $[RhCl_5(H_2O)]$ | 8.6 mg (giving 4 × $10^{-5}$ mol/total Ag mol) |

Solutions 1, 2 and 3 maintained at 70° C. and pH 4.5 were simultaneously added over 15 minutes with stirring to form nucleus grains. Subsequently, Solution 4 and Solution 5 shown above were added over 15 minutes, and 0.15 g of potassium iodide was added to complete the grain formation.

Then, the resulting grains were washed with water according to a conventional flocculation method. Specifically, after the temperature of the mixture was lowered to 35° C., 3 g of Anionic precipitating agent 1 was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In a volume of 3 L of the supernatant was removed again (second washing with water) The same procedure as the second washing with water was repeated once more (third washing with water) to complete the washing with water and desalting processes. The emulsion after the washing with water and desalting was added with 45 g of gelatin, and after pH was adjusted to 5.7 and pAg to 7.5, added with phenoxyethanol as an antiseptic to finally obtain a dispersion of cubic silver chloroiodobromide grains (i) containing 30 mol % of silver chloride and 0.08 mol % of silver iodide in average and having an average grain size of 0.45 μm with a variation coefficient of 10%. The emulsion finally showed pH of 5.7, pAg of 7.5, electric conductivity of 40 μS/m, density of 1.3–1.35×$10^3$ kg/$m^3$ and viscosity of 50 mPa·s.

Preparation of Coating Solutions

The silver halide photographic light-sensitive materials prepared in this example had a structure where UL layer, emulsion layer, lower protective layer and upper protective layer were formed in this order on one surface of the polyethylene terephthalate film support mentioned below, and an electroconductive layer and back layer were formed in this order on the opposite surface.

Compositions of coating solutions used for forming the layers are shown below.

| Coating solution for UL layer | |
|---|---|
| Gelatin | 0.3 g/$m^2$ |
| Polyethyl acrylate latex | 150 mg/$m^2$ |
| Compound (Cpd-7) | 40 mg/$m^2$ |
| Compound (Cpd-14) | 10 mg/$m^2$ |
| 5-Methylbenzotriazole | 40 mg/$m^2$ |
| Antiseptic (Proxcel, ICI Co., Ltd.) | 1.5 mg/$m^2$ |
| **Coating solution for emulsion layer** | |
| Emulsion A | 0.1 g/$m^2$ as silver amount |
| Sensitizing dye A | 5.7 × $10^{-4}$ mol/Ag mol |
| KBr | 3.4 × $10^{-4}$ mol/Ag mol |
| Compound (Cpd-1) | 2.0 × $10^{-4}$ mol/Ag mol |
| Compound (Cpd-2) | 2.0 × $10^{-4}$ mol/Ag mol |
| Compound (Cpd-3) | 8.0 × $10^{-4}$ mol/Ag mol |
| 4-Hydroxy-6-methyl-1,3,3a,7-tetrazaindene | 1.2 × $10^{-4}$ mol/Ag mol |
| Hydroquinone | 1.2 × $10^{-2}$ mol/Ag mol |
| Citric acid | 3.0 × $10^{-4}$ mol/Ag mol |
| Hydrazine compound | Type and amount shown in Table 1 |
| 2,4-Dichloro-6-hydroxy-1,3,5-triazine sodium salt | 90 mg/$m^2$ |
| Aqueous latex (Cpd-6) | 100 mg/$m^2$ |
| Polyethyl acrylate latex | 150 mg/$m^2$ |
| Colloidal silica (particle size: 10 μm) | 15 weight % as for gelatin |
| Compound (Cpd-7) | 4 weight % as for gelatin |
| Latex of copolymer of methyl acrylate, 2-acrylamido-2-methypropanesulfonic acid sodium salt and 2-acetoxyethyl methacrylate (weight ratio = 88:5:7) | 150 mg/$m^2$ |
| Core/shell type latex (core: styrene/butadiene copolymer (weight ratio = 37/63), shell: styrene/2-acetoxyethyl acrylate copolymer (weight ratio = 84/16), core/shell ratio = 50/50) | 150 mg/$m^2$ |

pH of the coating solution was adjusted to 5.6 by using citric acid.

The coating solution for emulsion layer prepared as described above was coated on the support mentioned below so that the coated silver amount and coated gelatin amount should become 2.9 g/$m^2$ and 1.2 g/$m^2$, respectively.

Cpd-1

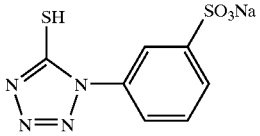

Cpd-2

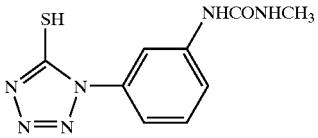

Cpd-3

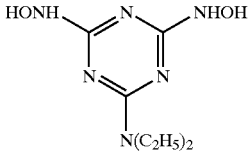

Hz-1

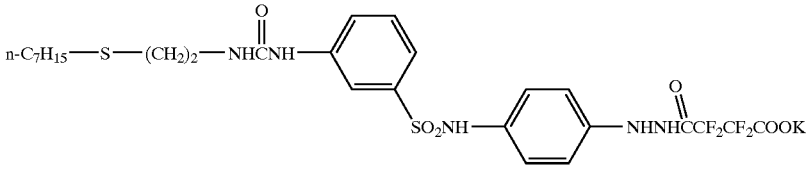

Hz-2

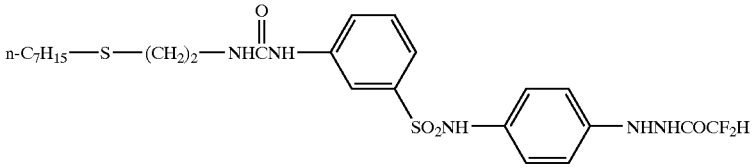

Cpd-6

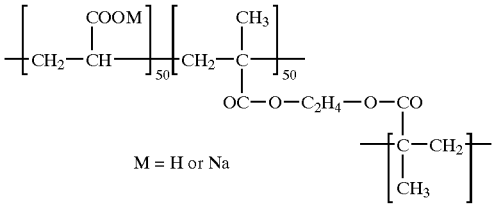

Cpd-7

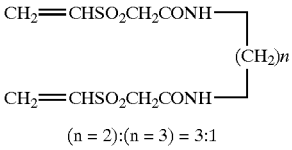

Sensitizing dye A

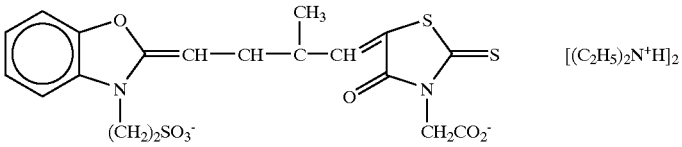

| Coating solution for lower protective layer | |
|---|---|
| Gelatin | 0.5 g/m$^2$ |
| Non-photosensitive silver halide grains | 0.1 g/m$^2$ as silver amount |
| Compound (Cpd-12) | 15 mg/m$^2$ |
| 1,5-Dihydroxy-2-benzaldoxime | 10 mg/m$^2$ |
| Polyethyl acrylate latex | 150 mg/m$^2$ |
| Compound (Cpd-13) | 3 mg/m$^2$ |
| Compound (Cpd-20) | 5 mg/m$^2$ |
| Antiseptic (Proxcel, ICI Co., Ltd.) | 1.5 mg/m$^2$ |
| **Coating solution for upper protective layer** | |
| Gelatin | 0.3 g/m$^2$ |
| Amorphous silica matting agent (average particle size: 3.5 μm) | 25 mg/m$^2$ |
| Compound (Cpd-8) (gelatin dispersion) | 20 mg/m$^2$ |
| Colloidal silica (particle size: 10–20 μm, Snowtex C, Nissan Chemical) | 30 mg/m$^2$ |
| Compound (Cpd-9) | 50 mg/m$^2$ |
| Sodium dodecylbenzenesulfonate | 20 mg/m$^2$ |
| Compound (Cpd-10) | 20 mg/m$^2$ |

-continued

| | |
|---|---|
| Compound (Cpd-11) | 20 mg/m$^2$ |
| Antiseptic (Proxcel, 101 Co., Ltd.) | 1 mg/m$^2$ |

Viscosity of the coating solutions for the layers was adjusted by adding Thickener Z mentioned below.

Cpd-8

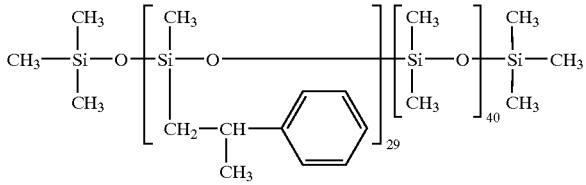

Cpd-9

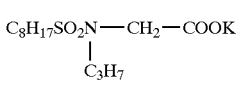

-continued

Cpd-10

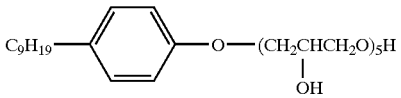

Cpd-11

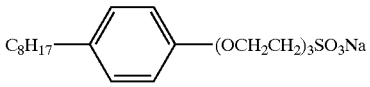

Cpd-12

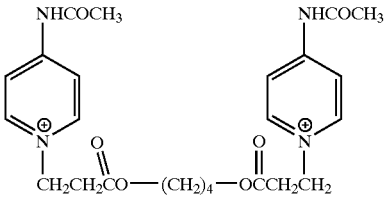

Cpd-13

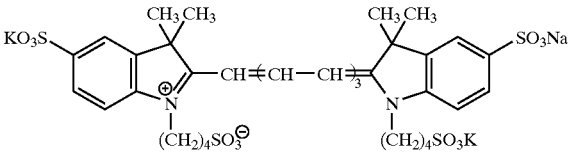

Cpd-14

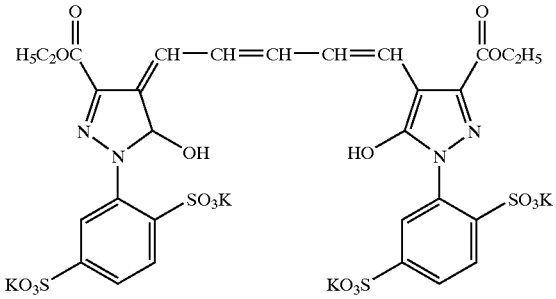

Thickener Z

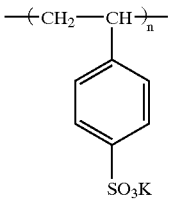

Coating solution for back layer

| | |
|---|---|
| Gelatin | 3.0 g/m$^2$ |
| Compound (Cpd-15) | 40 mg/m$^2$ |
| Compound (Cpd-16) | 20 mg/m$^2$ |
| Compound (Cpd-17) | 90 mg/m$^2$ |
| Compound (Cpd-18) | 40 mg/m$^2$ |
| Compound (Cpd-19) | 26 mg/m$^2$ |
| 1,3-Divinylsulfonyl-2-propanol | 60 mg/m$^2$ |
| Polymethyl methacrylate microparticles (mean particle sizes: 6.5 $\mu$m) | 30 mg/m$^2$ |
| Liquid paraffin | 78 mg/m$^2$ |
| Compound (Cpd-7) | 120 mg/m$^2$ |
| Compound (Cpd-20) | 5 mg/m$^2$ |
| Colloidal silica (particle size: 10 $\mu$m) | 15 weight % as for gelatin |
| Calcium nitrate | 20 mg/m$^2$ |
| Antiseptic (Proxcel, ICI Co., Ltd.) | 12 mg/m$^2$ |

-continued

Coating solution for electroconductive layer

| | |
|---|---|
| Gelatin | 0.1 g/m$^2$ |
| Sodium dodecylbenzenesulfonate | 20 mg/m$^2$ |
| $SnO_2$/Sb (weight ratio = 9:1, average particle size: 0.25 $\mu$m) | 200 mg/m$^2$ |
| Antiseptic (Proxcel, ICI Co., Ltd.) | 0.3 mg/m$^2$ |

Cpd-15

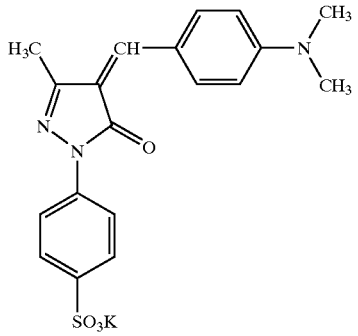

Cpd-16

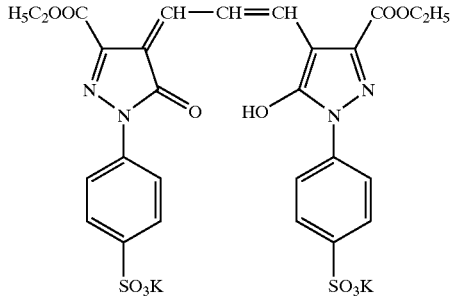

Cpd-17

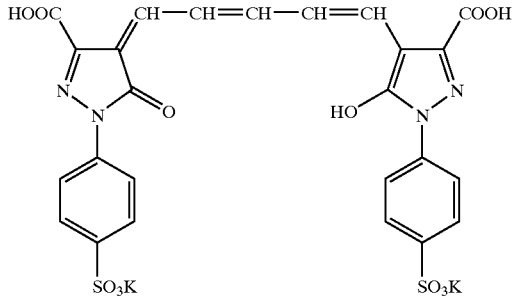

Cpd-18

$CH_3(CH_2)_{11}CH{=}CHSO_3Na$

Cpd-19

$CH_3(CH_2)_{11}CH_2{-}CH_2SO_3Na$

Cpd-20

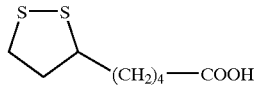

Support

On both surfaces of a biaxially stretched polyethylene terephthalate support (thickness: 175 $\mu$m), the coating solutions for first undercoat layer and second undercoat layer having the following compositions were coated.

| Coating solution for first undercoat layer | |
|---|---|
| Binder | Type and coated amount shown in Table 1 |
| Swellable inorganic stratifying compound (Swellable synthetic mica, Somasif ME100, aspect ratio: 1000 or more, mean particle diameter 1–5 μm, thickness several micrometers, COOP Chemical Co.) | Coated amount is shown in Table 1 |

The coating solution was coated so that a dry thickness shown in Table 1 should be obtained after drying at a drying temperature of 150° C. for 2 minutes.

| Coating solution for second undercoat layer | |
|---|---|
| Core/shell type vinylidene chloride copolymer (i) | Coated amount shown in Table 1 |
| 2,4-Dichloro-6-hydroxy-s-triazine | 0.25 g |
| Polystyrene microparticles (mean particle size: 3 pm) | 0.05 g |
| Compound (Cpd-2l) | 0.20 g |
| Colloidal silica (particle size: 70–100 μm Snowtex ZL, Nissan Chemical) | 0.12 g |
| Water making | Amount total amount 100 g |

The coating solution was adjusted to pH 6 by further addition of 10 weight % of KOH and coated so that a dry thickness of 0.9 μm should be obtained after drying at a drying temperature of 180° C. for 2 minutes.

| Coating solution for third undercoat layer | |
|---|---|
| Gelatin | 1 g |
| Methylcellulose | 0.05 g |
| Compound (Cpd-22) | 0.02 g |
| $C_{12}H_{25}O(CH_2CH_2O)_{10}H$ | 0.03 g |
| Antiseptic (Proxcel, ICI Co., Ltd.) | $3.5 \times 10^{-3}$ g |
| Acetic acid | 0.2 g |
| Water making | Amount total amount 100 g |

This coating solution was coated so that a dry thickness of 0.1 μm should be obtained after drying at a drying temperature of 170° C. for 2 minutes.

Core/shell type vinylidene chloride copolymer (i)

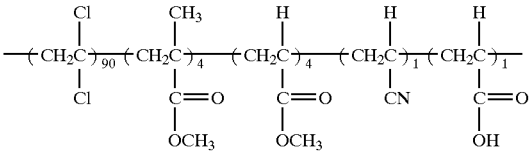

VDC MMa MA AN AA

Core: VDC/MMA/MA (80 weight %)
Shell: VDC/AN/AA (20 weight %)
Average particle size: 70 nm -continued Compound (Cpd-21)

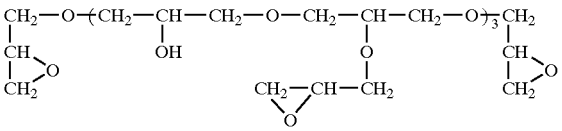

Compound (Cpd-22)

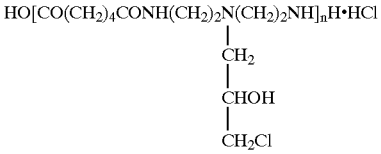

n = 10

Method for Coating on Support

First, on the aforementioned support coated with the undercoat layers, for the emulsion layer side, four layers of UL layer, emulsion layer, lower protective layer and upper protective layer were simultaneously coated as stacked layers in this order from the support at 35° C. by the slide bead coating method while adding a hardening agent solution, and passed through a cold wind setting zone (5° C.). Then, on the side opposite to the emulsion layer side, an electroconductive layer and a back layer were simultaneously coated as stacked layers in this order from the support by the curtain coating method while adding a hardening agent solution, and passed through a cold wind setting zone (5° C.). After the coated support was passed through each setting zone, the coating solutions showed sufficient setting. Subsequently, the layers coated on the both surfaces of the support were simultaneously dried in a drying zone of the drying conditions mentioned below. The coated support was transported without any contact with rollers and the other members after the coating of the back surface until it was rolled up. The coating speed was 200 m/min.

Drying Conditions

After the setting, the coated layers were dried with a drying wind at 30° C. until the water/gelatin weight ratio became 800%, and then with a drying wind at 35° C. and relative humidity of 30% for the period where the ratio became 200% from 800%. The coated layers were further blown with the same wind, and 30 second after the point where the surface temperature became 34° C. (regarded as completion of drying), the layers were dried with air at 48° C. and relative humidity of 2% for 1 minute. In this operation, the drying time was 50 seconds from the start to the water/gelatin ratio of 800%, 35 seconds from 800% to 200% of the ratio, and 5 seconds from 200% of the ratio to the end of the drying.

This silver halide photographic light-sensitive material was rolled up at 25° C. and relative humidity of 55%, cut under the same environment, conditioned for moisture content at 25° C. and relative humidity of 50% for 8 hours and then sealed in a barrier bag conditioned for moisture content for 6 hours together with a cardboard conditioned for moisture content at 25° C. and relative humidity of 50% for 2 hours to prepare each of Sample 1 to 18 mentioned in Table 1.

Humidity in the barrier bag was measured and found to be 45%. The obtained samples had a film surface pH of 5.5–5.8 for the emulsion layer side and 6.0–6.5 for the back side.

Measurement of Dimensional Change Ratio

For the obtained Samples 1 to 18, dimensional change observed with change of environmental humidity in a room was measured as follows. Two of holes having a diameter of 8 mm were formed on each sample with a spacing of 200 mm, and the sample was subjected to the following development treatment. The sample after the processing was left in a room of 25° C. and 60% relative humidity for 24 hours, and then the spacing of two of the holes was accurately measured by the pin-gauging method of 1/1000 mm precision in a room of 25° C. and 60% relative humidity. The length measured at this time was represented as X mm. Subsequently, the sample after the processing was immediately transferred into a room of 25° C. and 40% relative humidity and left for 15 minutes or 4 hours. Then, the spacing was measured and represented as Y mm. Ratio (%) of the dimensional change caused by change of environmental humidity in the room was calculated in accordance with the equation: Dimensional change ratio=(Y−X)×100/200 (%).

Method for Development

Each sample was processed with development conditions of 35° C. for 30 seconds by using a developer QR-D1 (Fuji Photo Film Co., Ltd.), a fixer NF-1 (Fuji Photo Film Co., Ltd.) and an automatic developing machine FG-680AG (Fuji Photo Film Co., Ltd.). The drying temperature was 45° C.

The results of the above evaluation are summarized in Table 1. From the result shown in Table 1, it can be seen that the samples according to the present invention showed good dimensional stability, in particular, almost no dimensional change even after passage of 4 hours.

TABLE 1

| | First undercoat layer | | | | Second undercoat layer Coated amount of core/shell type vinylidene chloride copolymer (i) ($g/m^2$) | Hydrasine compound | | Dimensional change ratio (%) | |
|---|---|---|---|---|---|---|---|---|---|
| | Binder | | Coated amount of swellable stratifying mica ($g/m^2$) | Film thickness ($\mu m$) | | | | | |
| Sample No. | Type | Coated amount ($g/m^2$) | | | | Type | Amount (mol/Ag mol) | After 15 minutes | After 4 hours |
| 1 (Comparative) | None | 0 | 0 | 0 | 0 | A-17 | $6.0 \times 10^{-4}$ | −0.006 | −0.015 |
| 2 (Comparative) | None | 0 | 0 | 0 | 1.54 | A-17 | $6.0 \times 10^{-4}$ | −0.002 | −0.011 |
| 3 (Comparative) | Poval R1130 (polyvinyl alcohol produced by Kuraray Co., Ltd.) | 3.5 | 0 | 2.0 | 0 | A-17 | $6.0 \times 10^{-4}$ | −0.017 | −0.03 |
| 4 (Invention) | Poval R1130 (polyvinyl alcohol produced by Kuraray Co., Ltd.) | 3.5 | 0.89 | 2.5 | 0 | A-17 | $6.0 \times 10^{-4}$ | 0 | 0.001 |
| 5 (Invention) | Poval R1130 (polyvinyl alcohol produced by Kuraray Co., Ltd.) | 1.4 | 0.35 | 1.0 | 0 | A-17 | $6.0 \times 10^{-4}$ | −0.001 | 0.003 |
| 6 (Invention) | Poval R1130 (polyvinyl alcohol produced by Kuraray Co., Ltd.) | 1.4 | 0.7 | 1.2 | 0 | A-17 | $6.0 \times 10^{-4}$ | 0 | 0.001 |
| 7 (Invention) | Poval R1130 (polyvinyl alcohol produced by Kuraray Co., Ltd.) | 0.7 | 0.3 | 0.6 | 0 | A-17 | $6.0 \times 10^{-4}$ | 0 | −0.002 |
| 8 (Comparative) | Poval R1130 (polyvinyl alcohol produced by Kuraray Co., Ltd.) | 0.7 | 0 | 0.4 | 0 | A-17 | $6.0 \times 10^{-4}$ | −0.008 | −0.017 |
| 9 (Comparative) | Exceval HR (polyvinyl alcohol | 1.4 | 0 | 0.8 | 0 | A-17 | $6.0 \times 10^{-4}$ | −0.016 | −0.028 |

TABLE 1-continued

| | First undercoat layer | | | | Second undercoat layer Coated amount of core/shell type vinylidene chloride copolymer (i) | Hydrasine compound | | Dimensional change ratio (%) | |
|---|---|---|---|---|---|---|---|---|---|
| | Binder | | Coated amount of swellable stratifying mica | | | | | | |
| Sample No. | Type | Coated amount ($g/m^2$) | ($g/m^2$) | Film thickness ($\mu m$) | ($g/m^2$) | Type | Amount (mol/Ag mol) | After 15 minutes | After 4 hours |
| | produced by Kuraray Co., Ltd.) | | | | | | | | |
| 10 (Invention) | Exceval HR (polyvinyl alcohol produced by Kuraray Co., Ltd.) | 1.4 | 0.35 | 1.0 | 0 | A-17 | $6.0 \times 10^{-4}$ | 0 | −0.003 |
| 11 (Comparative) | PVA-217 (polyvinyl alcohol produced by Kuraray Co., Ltd.) | 1.4 | 0 | 0.8 | 0 | A-17 | $6.0 \times 10^{-4}$ | −0.018 | −0.03 |
| 12 (Invention) | PVA-217 (polyvinyl alcohol produced by Kuraray Co., Ltd.) | 1.4 | 0.35 | 1.0 | 0 | A-17 | $6.0 \times 10^{-4}$ | −0.001 | −0.003 |
| 13 (Comparative) | Core/shell type vinylidene chloride copolymer (i) | 1.4 | 0 | 0.9 | 0 | A-17 | $6.0 \times 10^{-4}$ | −0.002 | −0.012 |
| 14 (Inventions) | Core/shell type vinylidene chloride copolymer (i) | 1.4 | 0.5 | 1.8 | 0 | A-17 | $6.0 \times 10^{-4}$ | 0 | −0.001 |
| 15 (Compartive) | LACSTAR 330TB (styrene/botadlene rubber resin produced by Dal-Nippon Ink & Chemicals Inc. | 1.4 | 0 | 0.9 | 0 | A-17 | $6.0 \times 10^{-4}$ | −0.006 | −0.016 |
| 16 (Invention) | LACSTAR 330TB (styrene/botadlene rubber resin produced by Dal-Nippon Ink & Chemicals Inc. | 1.4 | 0.5 | 1.3 | 0 | A-17 | $6.0 \times 10^{-4}$ | −0.001 | −0.002 |
| 17 (Comparative) | Gelatin | 1.4 | 0 | 1.0 | 0 | A-17 | $6.0 \times 10^{-4}$ | −0.011 | −0.019 |
| 18 (Invention) | Gelatin | 1.4 | 0.7 | 1.7 | 0 | A-17 | $6.0 \times 10^{-4}$ | −0.002 | −0.006 |

EXAMPLE 2

In addition to the above evaluation of dimensional stability, Samples 19 to 25 (characteristics are shown in Table 2) prepared in the same manner as in Example 1 were evaluated for processing stability as follows. In case of use for IC printed boards, unless this processing stability is good, line width may change even if the dimensional stability is favorable, and therefore circuits can no longer be integrated.

Evaluation of Processing Stability

Each sample was evaluated for processing stability as follows.

Light Exposure

Test steps were outputted by using an image setter (RC5600V, Fuji Photo Film Co., Ltd.) at 175 lines/inch with changing the light quantity and developed under the conditions mentioned above. The exposure was performed at an LV value giving 50% of medium half tone dots, and density of a Dmax portion was measured as practice density. The half tone % and the practice density were measured by using a densitometer (Macbeth TD904).

Evaluation of Processing Stability of Silver Halide Photographic Light-Sensitive Materials Each sample prepared as shown in Table 2 was processed in an amount of ten sheets in the Daizen size (50.8×61.0 cm) blackened for 15% per day by using a developer QR-D1 with replenishing the used solution in an amount of 50 ML per one sheet of the Daizen size. This daily operation was performed for 5 days in a week, and this running was continued for 3 weeks. In this manner, a developer undergone running of processing was prepared.

Changes of practice density and half tone % obtained by exposure at an LV value giving 50% of medium half tone dots and development using the above developer observed after the running compared with those before the running were evaluated. A higher practice density is more preferred. The percentage of half tone dot change was evaluated by measuring degree of the change from 50% half tone as Δ half tone %. A smaller Δ half tone % indicates more favorable processing stability.

The results of these evaluations are summarized in Table 2. From the results shown in Table 2, it can be seen that the samples according to the present invention showed not only good dimensional stability, but also high practice density and little changes after processing, because of the use of the hydrazine compounds represented by the formula (1) or (2), which are preferably used in the present invention.

TABLE 2

| | First undercoat layer | | | | Second undercoat layer | Hydraxine compound | | Dimensional change ratio (%) | | Processing stability | |
|---|---|---|---|---|---|---|---|---|---|---|---|
| | Binder | | Coated Amount | | Coated amount of | | | | | | |
| Sample No. | Type | Coated amount ($g/m^2$) | of swellable stratifying mica ($g/m^2$) | Film thickness ($\mu m$) | core/shell type vinylidene chloride copolymer (i)($g/m^2$) | Type | Amount (mol/Ag mol) | After 15 minutes | After 4 hours | Practice density | Change of half tone dot (%) |
| 19 (Invention) | Poval R1130 (polyvinyl alcohol produced by Kuraray Co., Ltd.) | 1.4 | 0.7 | 1.2 | 0 | Hz-1 | $7.5 \times 10^{-4}$ | 0 | 0.001 | 4.0 | +15 |
| 20 (Invention) | Poval R1130 (polyvinyl alcohol produced by Kuraray Co., Ltd.) | 1.4 | 0.7 | 1.2 | 0 | Hz-2 | $7.6 \times 10^{-4}$ | 0 | 0.001 | 3.9 | +20 |
| 21 (Invention) | Poval R1130 (polyvinyl alcohol produced by Kuraray Co., Ltd.) | 1.4 | 0.7 | 1.2 | 0 | A-17 | $6.0 \times 10^{-4}$ | 0 | 0.001 | 4.4 | +2 |
| 22 (Invention) | Poval R1130 (polyvinyl alcohol produced by Kuraray Co., Ltd.) | 1.4 | 0.7 | 1.2 | 0 | A-32 | $6.0 \times 10^{-4}$ | 0 | 0.001 | 4.5 | +2 |
| 23 (Invention) | Poval R1130 (polyvinyl alcohol produced by Kuraray Co., Ltd.) | 1.4 | 0.7 | 1.2 | 0 | A-77 | $6.0 \times 10^{-4}$ | 0 | 0.001 | 4.5 | +1 |
| 24 (Invention) | Exceval HR (polyvinyl alcohol produced by Kuraray Co., Ltd.) | 1.4 | 0.35 | 1.2 | 0 | A-17 | $6.0 \times 10^{-4}$ | 0 | −0.003 | 4.4 | +2 |
| 25 (Invention) | Exceval HR | 1.4 | 0.35 | 1.2 | 0 | A-32 | $6.0 \times 10^{-4}$ | 0 | −0.003 | 4.5 | +2 |

TABLE 2-continued

| Sample No. | First undercoat layer: Binder: Type | Binder: Coated amount ($g/m^2$) | Coated Amount of swellable stratifying mica ($g/m^2$) | Film thickness ($\mu m$) | Second undercoat layer: Coated amount of core/shell type vinylidene chloride copolymer (i)($g/m^2$) | Hydraxine compound: Type | Hydraxine compound: Amount (mol/Ag mol) | Dimensional change ratio (%): After 15 minutes | Dimensional change ratio (%): After 4 hours | Processing stability: Practice density | Processing stability: Change of half tone dot (%) |
|---|---|---|---|---|---|---|---|---|---|---|---|
| | (polyvinyl alcohol produced by Kuraray Co., Ltd.) | | | | | | | | | | |

According to the present invention, a silver halide photographic light-sensitive material showing good dimensional stability, further, such a silver halide photographic light-sensitive material also showing high practice density and superior processing stability, can be provided.

What is claimed is:

1. A silver halide photographic light-sensitive material having layers containing a swellable inorganic stratifying compound on both sides of a support and having at least one silver halide emulsion layer on at least one of the layers wherein the swellable inorganic stratifying compound is swellable synthetic mica or bentonite.

2. The silver halide photographic light-sensitive material according to claim 1, which contains polyvinyl alcohol as a binder of the layers containing the swellable inorganic stratifying compound.

3. The silver halide photographic light-sensitive material according to claim 1, which contains polymer latex as a binder of the layers containing the swellable inorganic stratifying compound.

4. The silver halide photographic light-sensitive material according to claim 1, further comprising a binder, wherein the swellable inorganic stratifying compound and the binder are contained in the layers containing the swellable inorganic stratifying compound in a weight ratio of 1/10–10/1.

5. The silver halide photographic light-sensitive material according to claim 1, wherein the swellable inorganic stratifying compound has a mean aspect ratio of 100 or more.

6. The silver halide photographic light-sensitive material according to claim 1, wherein the swellable synthetic mica has a thickness of 1–50 nm and a face size of 1–20 $\mu$m.

7. The silver halide photographic light-sensitive material according to claim 1, which contains the swellable inorganic stratifying compound in an amount of 5–5000 $mg/m^2$.

8. The silver halide photographic light-sensitive material according to claim 1, which contains the swellable inorganic stratifying compound in an amount of 50–500 $mg/m^2$.

9. A silver halide photographic light-sensitive material having layers containing a swellable inorganic stratifying compound on both sides of a support and having at least one silver halide emulsion layer on at least one of the layers, which comprise at least one hydrazine compound in at least one of layers formed on the side of the support having the silver halide emulsion layer.

10. The silver halide photographic light-sensitive material according to claim 9, wherein the hydrazine compound is a hydrazine compound having an onium group in the molecule.

11. The silver halide photographic light-sensitive material according to claim wherein the hydrazine compound having an onium group in the molecule is represented by the following formula (1) or (2):

Formula (1)

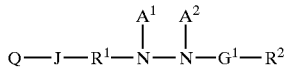

(1)

Formula (2)

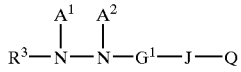

(2)

wherein, in the formulas (1) and (2), $R^1$ represents an arylene group or a divalent heterocyclic group, Q represents an onium group, J represents a divalent bridging group, $G^1$ represents —CO— group, —$SO_2$— group, —SO— group, —COCO— group, thiocarbonyl group, iminomethylene group or —P(O)($G^2R^4$)— group, where $G^2$ represents a single bond, —O— group or —$NR^4$— group, and $R^4$ represents a hydrogen atom, an aliphatic group, an aryl group or a heterocyclic group, $R^2$ represents a hydrogen atom, an alkyl group, an aryl group, a heterocyclic group, an alkoxyl group, an aryloxy group, an amino group or a carbamoyl group, $R^3$ represents an aryl group or a heterocyclic group, and both of $A^1$ and $A^2$ represent a hydrogen atom, or one of them represents a hydrogen atom, and the other represents an acyl group, a sulfonyl group or an oxalyl group.

12. The silver halide photographic light-sensitive material according to claim 11, wherein the hydrazine compound having an onium group in the molecule is represented by the formula (1).

13. The silver halide photographic light-sensitive material according to claim 12, wherein, in the formula (1), an atom of J directly bonding to $R^1$ is not a nitrogen atom.

14. The silver halide photographic light-sensitive material according to claim 12, wherein, in the formula (1), the group represented by $G^1$ is —CO—, and the group represented by $R^2$ is an alkyl group that does not have an onium group or a carbamoyl group that does not have an onium group.

15. The silver halide photographic light-sensitive material according to claim 12, wherein, in the formula (1), the group represented by —$G^1$—$R^2$ is —$COCF_2H$ or —$COCF_2CF_2COOM$, and M represents a hydrogen atom or a counter cation.

16. The silver halide photographic light-sensitive material according to claim 12, wherein, in the formula (1), the bridging group represented by $R^1$ is an unsubstituted phenylene group.

17. The silver halide photographic light-sensitive material according to claim 12, wherein the compound of the formula (1) is represented by the following formula (1-a) or (1-b):

Formula (1-a)

(1-a)

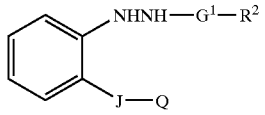

-continued

Formula (1-b)

(1-b)

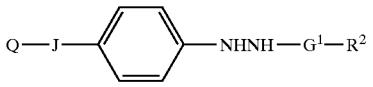

wherein, in the formulas (1-a) and (1-b), $—G^1—R^2$ is $—COCF_2H$ or $—COCF_2CF_2COOM$, M represents a hydrogen atom or a counter cation, J represents an alkylene group, and Q represents a pyridinium group or a quinolinium group.

* * * * *